United States Patent [19]

Hori et al.

[11] 4,152,140

[45] May 1, 1979

[54] METHOD FOR PRODUCING KILLED STEELS FOR CONTINUOUS CASTING

[75] Inventors: Sankichi Hori; Yasunori Owada; Akihiko Kusano, all of Ohita, Japan

[73] Assignee: Nippon Steel Corporation, Tokyo, Japan

[21] Appl. No.: 818,348

[22] Filed: Jul. 22, 1977

[30] Foreign Application Priority Data

| | | | |
|---|---|---|---|
| Jul. 28, 1976 | [JP] | Japan | 51-89856 |
| Mar. 2, 1977 | [JP] | Japan | 52-22366 |
| Mar. 2, 1977 | [JP] | Japan | 52-22367 |
| Mar. 2, 1977 | [JP] | Japan | 52-22368 |
| Mar. 2, 1977 | [JP] | Japan | 52-25008 |

[51] Int. Cl.[2] ..... C21C 7/10

[52] U.S. Cl. ..... 75/49; 75/58; 266/208; 266/89

[58] Field of Search ..... 75/49, 58; 266/208–210

[56] References Cited

U.S. PATENT DOCUMENTS

| | | | |
|---|---|---|---|
| 3,695,946 | 10/1972 | Demeaux | 75/49 |
| 3,702,243 | 11/1972 | Miltenberger | 75/49 |

*Primary Examiner*—P. D. Rosenberg

*Attorney, Agent, or Firm*—Toren, McGeady and Stanger

[57] ABSTRACT

A method for producing a killed molten steel for continuous casting, which comprises;

a step of preparing a molten steel with a blow-off carbon content not less than 0.05% in a converter, a step of pouring the molten steel to a ladle, and a step of degassing the molten steel in vacuum degassing vessel under a vacuum within a range of from 10 to 300 mmHg, with addition of at least one element selected from the group consisting of Al, Si and Mn, while stepwisely adjusting the vacuum in correspondence to the degree of decarburization of the molten steel.

6 Claims, 17 Drawing Figures

METHOD FOR PRODUCING KILLED STEELS FOR CONTINUOUS CASTING

BACKGROUND OF THE INVENTION

1. Field of the Invention

The present invention relates to a method for producing killed steels, such as Al-killed, Si-killed and Al-Si-killed steels for continuous casting.

2. Description of the Prior Art

Conventional methods for producing Al-killed, Si-killed or Al-Si-killed steels comprise controlling the oxygen blowing to a converter so as to obtain a steel composition and temperature predetermined for a specific steel grade, while adding alloying elements to the converter, adjusting the steel composition by adding alloying elements on the basis of sampling results at the finishing stage or the blow-off stage of the oxygen blowing or at the time of tapping, and supplying the molten steel thus obtained to a continuous casting machine through a ladle and a tundish. Therefore, in the conventional methods, the converter is subjected to severe operation conditions for a long period of time, and the operation conditions vary depending on grades of steel to be produced, so that the control of the oxygen-blown refining in the converter is very complicated.

For example, for producing of a low-carbon Al-killed steel containing 0.09% or less carbon for continuous casting, the carbon content at the time of blow termination (blow-off carbon content) is maintained in a range from 0.03 to 0.06% in view of the increase in carbon content from addition of Fe-Mn, etc. to the ladle during the pouring so that the total Fe % in the slag exceeds 20%, thus producing excessive oxidized molten steel which causes considerable shortening of the converter and ladle refractory linings, as well as loss of iron yield in the molten steel. The above disadvantages caused by the excessively oxidized molten steel have been regarded as being unavoidable and inherent to the conventional methods, and resulted in considerable fluctuation in the blown-off temperature and the steel composition in the converter operation according to the conventional methods.

Further, due to the excessively oxidized condition of the molten steel, the manganese content at the blow-off is 0.13% or less when the blow-off carbon content is from 0.03 to 0.06%. Therefore, in order to obtain a predetermined steel composition, the addition of a larger amount of Fe-Mn (for example 3 kg/ton of molten steel) is required, and for this addition, a low-carbon Fe-Mn is required because the carbon content in the final product very often exceeds its upper limit due to pick-up of carbon from Fe-Mn and causes rejects. However, the low-carbon Fe-Mn, as compared with a high-carbon Fe-Mn, requires a much large power consumption for its production and costs about two times more than the high-carbon Fe-Mn. Therefore, the use of a low-carbon Fe-Mn will cause disadvantages in the production cost of molten steel.

Further, the excessive oxidation of molten steel lowers the yield rate of ferro-alloys and increases fluctuation in the steel compositions so that in the conventional methods one is required to predetermine the target values for the final product at a considerably higher level than the actual values and to provide a wider range of tolerance. Thus, the above disadvantages due to the excessive oxidation of the molten steel have been unavoidable and inherent in the production of low-carbon Al-killed or Si-killed molten steels for continuous casting because of the necessity of maintaining the blow-off carbon content in a range from 0.03 to 0.06%.

Further, according to the conventional methods, Al or Si is added to the molten steel during pouring after the blow-termination or to the ladle after the pouring, so that in the case of the ordinary addition during the pouring, only less than 25% Al addition yield and about 40 to 80% Si addition yield can be achieved. In the case of a special and complicated addition, such as, high-speed addition in the forms of Al wire or Al bullet, and addition under non-oxidizing atmosphere and/or under stirring, only about 30 to 40% addition yield can be achieved for Al and only about 50 to 80% addition yield can be achieved for Si. Thus in the conventional methods, the loss of Al and Si during their addition to the molten steel is very large. In the case of Si addition, even when Al is added in an amount from 0.001 to 0.008% as the total Al so as to stabilize the Si addition, only 60 to 85% addition yield with considerable fluctuation can be achieved. In this way, a considerable amount of alumina and/or oxide inclusions are produced in the molten steel due to the loss of Al and/or Si during their addition, and these inclusions cause not only deterioration of the molten steel quality, but also difficulties in the continuous casting operation, such as, clogging of the pouring nozzle.

Further, according to the conventional methods, addition of elements other than Al and Si has been effected simultaneously with Fe-Mn-Al or Fe-Mn-Si to the molten steel during the pouring or to the ladle after the pouring. In this case, also, just as Fe-Mn, Al or Si, the addition yield of other elements is low and fluctuates considerably due to the excessive oxidation of the molten steel.

As another disadvantage of the conventional methods, it is required that the pouring temperature of the molten steel from the converter is set so as to assure a molten steel temperature within the tundish 20° to 40° C. higher than the solidification temperature. Thus, the molten steel temperature within the tundish is not higher than the solidification point by more than 20° C., a large amount of alumina or oxide adhesion is formed around the pouring nozzle, and this causes early clogging of the nozzle and hence difficulties in continuing a smooth casting operation.

On the other hand, if the molten steel temperature within the tundish is higher than the solidification by more than 40° C., the solidification speed in the mold is lowered, and this causes slab surface defects, such as, slag or powder entrappment. In order to prevent such surface defects, the casting speed must be limited to an appropriate speed. For this reason, in the case of Al-killed steels, 10 to 30% surface conditioning is required as shown in FIG. 8, and in the case of Si-killed steels about 15% surface conditioning is required.

Further, even when the temperature within the tundish is maintained 20° to 40° C. higher than the solidifying temperature and a "bank" is provided within the tundish or the shape of the immersion nozzle is improved so as to remove the alumina or oxide inclusions, a completely satisfactory result can not be achieved and as shown in FIG. 6, the alumina cluster or oxide inclusions segregate in the thickness direction of the slab, and when such slabs are used for production of cold rolled steel sheets, the surfacial portion of the slab is conditioned and removed after the coating. This causes considerable lowering of the iron yield of the slabs. In the case of a continuous casting machine of curved strand type, the alumina clusters or oxide inclusions which segregate at ¼ thickness portions of the slabs, are exposed as sliver defects on the surfaces of the cold rolled steel sheets produced from such slabs, thus causing considerable lowering of the product yield as shown in FIG. 7.

In FIG. 6, the solid line (1) represents the distribution of alumina clusters in a slab produced by adding the total amount of Fe-Mn and Al during the pouring, while the chained line (2) represents the distribution of alumina cluster in a slab produced by adding only Fe-Mn during the pouring and adding Al under a non-oxidizing atmosphere after the pouring with stirring.

As mentioned above, Al-killed, Si-killed or Al-Si-killed steel products having satisfactory inner and surfacial qualities could not be obtained by the conventional methods.

Meanwhile, in order to eliminate the defects of Al-killed, Si-killed or Al-Si-killed steels produced by the conventional methods, various experiments have been tried, including pouring the molten steel under non-oxidized or semi-oxidized conditions to a ladle and subjecting the molten steel to a vacuum degassing treatment.

However, the degassing operation has been regarded and established as production means only for production of extremely low-hydrogen and extremely low-carbon steels for high-grade thick plates, and the degassing treatment has been performed under the conditions of 1–5 mmHg vacuum rate and 4–10 circulations (definitions will be set forth hereinafter), so that a large scale of a vacuum generator as well as a long period of treating time has been required, resulting in a considerable temperature lowering during the treatment. Therefore, it is necessary to maintain the blow-off temperature in the converter 20° to 50° C. higher as compared with an ordinary non-degassed molten steel in order to maintain the molten steel temperature within the tundish 20° to 40° C. higher than the solidifying temperature as mentioned before. This procedure, however, causes remarkable loss and damage of the refractories of the converter and the ladle, as well as the degassing equipment, and increases the consumption of various energy sources, such as, vapour for the vacuum generator, and power and Ar gas for the degassing equipment, resulting in increased total cost of the degassing treatment. Thus, vacuum degassing of ordinary molten steels, such as, Al-killed, Si-killed or Al-Si-killed steels for continuous casting would result in severe damage of the refractories of the converter, the ladle and the degassing equipment, and a remarkable increase in the degassing cost.

Further, in the conventional methods, as most parts of Mn, Si and Al for composition adjustment are added during the pouring, their addition yield is low while the N content in the steel increases considerably. This is not desirable for the production of steel grades which require a low N content. In addition, during the addition of Mn, Si and Al, the hydrogen (H) content in the steel increases due to the water adhering to these additives, so that it is necessary to remove this increased hydrogen content and for this removal, the vacuum degassing is performed under a high degree of operation load.

In order to improve the addition yield of the above elements, and to lower the hydrogen (H) and (N) contents in the steel, it has been proposed to pour a molten steel prepared in a converter to a ladle under a non-deoxidized or semi-oxidized condition, and to add the above elements during a high-vacuum degassing treatment.

Meanwhile, when non-deoxidized molten steel is subjected to vacuum degassing under conventional conditions, the splash phenomenon, which is caused by a decarburization reaction during the treatment is very remarkable, and particularly in the case of molten steels containing 0.05% or more blow-off carbon content, so that a smooth degassing treatment can not be easily achieved and equipmental troubles result such that the molten steel blows from the degassing vessel into the vacuum exhausting system. Therefore, up to now, the vacuum degassing treatment has not been applied to Al-killed, Si-killed or Al-Si-killed steels for continuous casting because of these great disadvantages.

SUMMARY OF THE PRESENT INVENTION

Therefore one of the purposes of the present invention is to overcome the various problems and difficulties confronted by the conventional production methods of Al-killed, Si-killed or Al-Si-killed steel for continuous casting, and to provide a method for producing Al-killed, Si-killed or Al-Si-killed molten steels for continuous casting by combining appropriate conditions of the converter operation with appropriate conditions of the degassing treatment to obtain a high degree of efficiency in view of the equipment and the operations with great economical advantages.

The features of the present invention are that the blow-off carbon content of the molten steel in the converter is maintained at a value of not less than about 0.05%; the molten steel is poured into a ladle without addition of ferro-alloy or with the addition of a small amount of Fe-Mn during the pouring, then the molten steel is transferred to a degassing vessel where the molten steel is degassed under a vacuum degree of 10–300 mmHg produced by a vacuum generator; and during the most active stage of decarburization reaction, the vacuum rate is maintained at a lower value, and as the decarburization of the molten steel proceeds, the vacuum degree is adjusted higher; Al, Si or Al and Si with other required alloying elements are added to the molten steel during the degassing treatment; and the thus obtained molten steel is supplied to a continuous casting machine.

Figure 1:
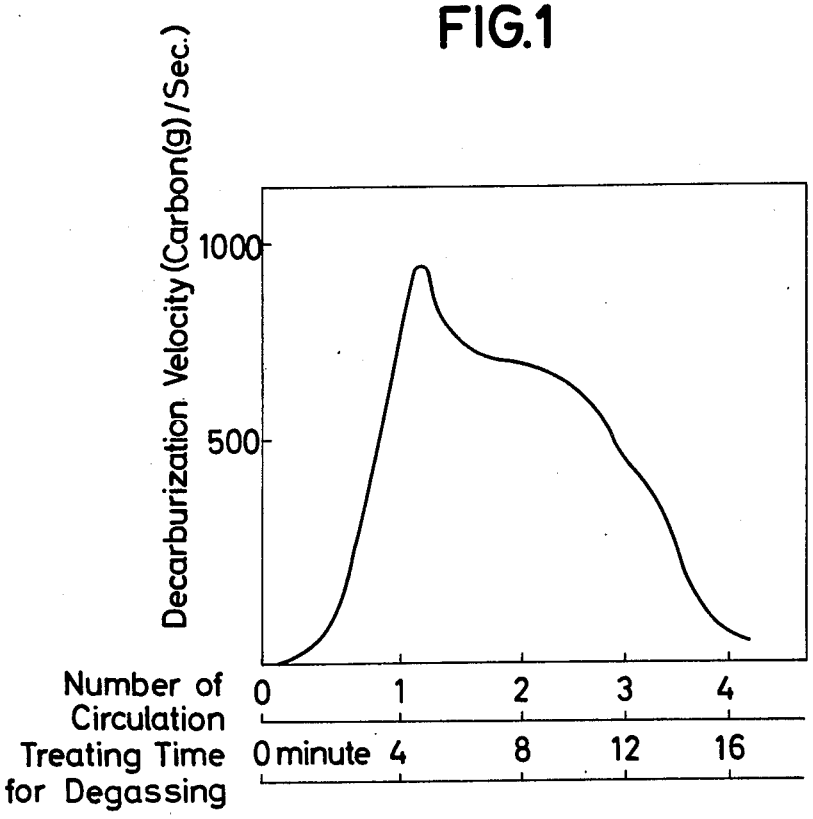
FIG. 1 is a graph showing the relation between the treating time and the decarburization velocity in the degassing vessel in the case of vacuum degassing of a non-deoxidized steel.

According to the present invention, the blow-off carbon content of the molten steel at the blow-termination is maintained at not less than about 0.05%. If the blow-off carbon content is less than 0.05%, the oxygen content in the molten steel at the blow termination of the converter is considerably larger and a longer period of time is required for the subsequent degassing treatment so that the desired load-relief in the degassing treatment can not be obtained. In addition, it is not possible to obtain the desired time sequence between the degassing treatment and the continuous casting and it is very often required to stop the continuous casting operation, thus lowering the production efficiency of the continuous casting operation.

Further, when a molten steel containing less than 0.05% blow-off carbon is supplied to the degassing treatment, the yield of Al and/or Si addition during the degassing treatment lowers and a large amount of alumina and/or oxide inclusions is produced because the oxygen content in the molten steel is high and the degassing is done under a light vacuum rate, so that the cleanness of the molten steel after the degassing is low, and difficulty in the subsequent continuous casting operation, such as, the nozzle clogging by the oxide product is caused very often. Also severe damages of the refractories of the converter and the ladle result. For the above reasons, the blow-off carbon content is maintained at not less than 0.05% in the present invention, and by this feature, it is possible to easily control the total Fe % in the slag during the converter treatment to a value of not more than 18%. As a result, the disadvantages caused by the excessive oxidation of the molten steel in the conventional methods have been completely eliminated, hence eliminating the loss of life of the refractories of the converter and the ladle, and considerably improving the iron yield rate of the molten steel.

Further, the present invention has reduced the fluctuations in the temperature and the carbon content of the molten steel at the blow-termination in the converter, thus improving the accuracy of the blow-off control remarkably as compared with the conventional methods.

Further, according to the present invention, it is possible to easily control the blow-off Mn content to not less than 0.15% so that the amount of Fe-Mn required for the final composition is much less than that required in the conventional methods and thus the decarburization required in the subsequent degassing treatment is considerably less. Therefore, high-carbon Fe-Mn can be used without the necessity of the partial use of low-carbon Fe-Mn which requires a large power consumption for its production. In this point, the present invention is advantageous in saving the power energy consumption, thus lowering the cost for the molten steel treatment considerably.

A second feature of the present invention is that the molten steel is poured out the converter in a non-deoxidized state to the ladle without the addition of alloying elements or with the addition of a small amount of Fe-Mn during the pouring. By this feature, the molten steel is deoxidized by the reaction of $[C] + [O] \rightarrow CO$ during the degassing treatment and the oxygen content is lowered efficiently to a predetermined value, thus the increase of H accompanied with the addition of Mn, Si, Al, etc. during the pouring as seen in the conventional methods is prevented, and the potential H and N during the pouring are removed together with CO gas.

On the other hand, when alloying elements required for the final product to be obtained are added during the pouring, the oxygen in the molten steel is lost so that the reaction of $[C] + [O] \rightarrow CO$ is weakened and the progress of the reaction is hindered, thus lowering the treating efficiency. Meanwhile, when no alloying element is added during the pouring, it sometimes happens that the molten steel moves vigorously and flows out of the ladle. In such a case, it is desirable to add a small amount of Fe-Mn.

The vacuum degassing according to the present invention is performed under a vacuum degree of from 10 to 300 mmHg provided by a vacuum generator, and the vacuum degree is lowered (near 300 mmHg) during the most active stage of the decarburization reaction, and is adjusted to a higher level (near 10 mmHg) as the decarburization reaction proceeds.

The decarburization reaction in the vacuum degassing treatment is usually the reaction of $[C] + [O] \rightarrow CO$ under a reduced pressure, and the relation between the reaction and the treating time is shown in FIG. 1 (350 ton heat, by RH degassing vessel) in which, when the vacuum degree in the degassing vessel reaches a predetermined value after the start of the treatment, the peak of the decarburization reaction appears, and after the reaction peak, the decarburization speed tends to decrease as the decarburization reaction proceeds.

Figure 2A:
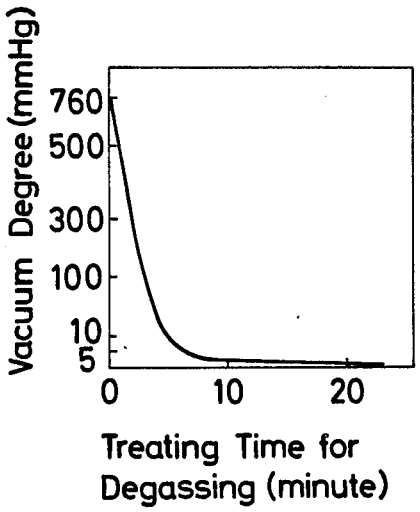
FIGS. 2(*a*) and (*b*) are graphs both showing the relation between the treating time and the degree of vacuum.
Figure 2B:
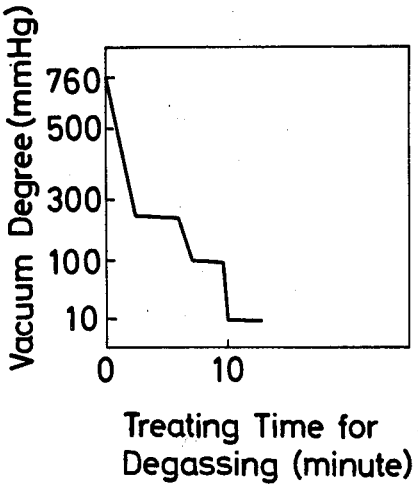
Figure 3A:
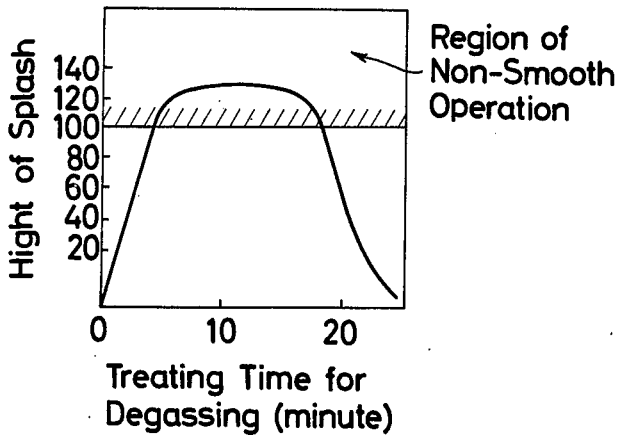
FIGS. 3(*a*) and (*b*) are graphs both showing the relation of the splash height and the treating time.
Figure 3B:
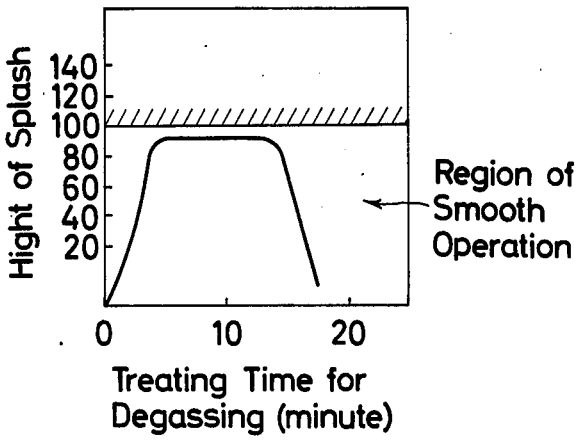

In the vacuum degassing treatment according to the conventional methods, the vacuum degree is set as shown in FIG. 2(*a*), and the splashing of the molten steel in the degassing vessel is very vigorous for about ½ of the treating time beginning from the most active stage of the decarburization reaction and projecting into the zone of difficult operation as shown in FIG. 3(*a*). Thus, the vacuum degassing treatment according to the conventional methods is accompanied with the deposition of the molten metal on the wall of the degassing vessel as well as the metal splashing so that it is very often necessary to stop the degassing treatment and wait until the splashing subsides before the degassing treatment is started again so as to perform the degassing treatment smoothly. Therefore, in the conventional methods, the treating time in the degassing vessel is unnecessarily long during which the molten steel temperature lowers considerably so that the pouring temperature in the converter operation must be increased so as to compensate the above temperature lowering and thus the condition of the converter operation becomes more severe.

The vacuum degassing treatment according to the present invention is performed with a vacuum degree of from 10 to 30 mmHg provided by a vacuum generator, and the vacuum degree is adjusted to a low vacuum degree (near 300 mmHg) as shown in FIG. 2(*b*) during the most active stage of the decarburization reaction as shown in FIG. 1, so as to control the height of the splash within the smooth operation zone as shown in FIG. 3(*b*), and as the decarburization proceeds, the vacuum degree is adjusted to a higher level (near 10 mmHg) that the decarburization reaction proceeds rapidly and a smooth and efficient degassing treatment is achieved.

The adjustment of the vacuum degrees in the vessel along the decarburization speed as described above is very important for practical purposes, and when the vacuum degree is adjusted to a value less than 10 mmHg, the reaction of [C] + [O] → CO becomes remarkably active in the degassing stage as explained in connection with FIG. 2(*a*) and FIG. 3(*a*), so that the molten steel splashes vigorously in the vessel. It then becomes difficult to continue the degassing treatment because the molten steel deposits and solidifies on the wall of the treating vessel to cause various problems.

Namely, the vigorous CO reaction in the degassing vessel causes a considerable temperature lowering of the molten steel during this treatment and requires an increased blow-off temperature of the converter to impose a large thermal load on the refractories of the converter and the ladle.

Further, the splashing of the molten steel is very apt to take place, which requires stopping of the degassing treatment. Consequently, the time correspondency between the degassing treatment and the continuous casting operation is not in the proper order and the continuous casting operation is stopped, thus resulting in operational difficulties.

On the other hand, the pressure in the degassing vessel is raised beyond 300 mmHg, smooth circulation of the molten steel in the degassing vessel is not achieved, the reaction of [C] + [O] → CO is not satisfactory and it is impossible to perform the degassing treatment rapidly and accurately.

Figure 4:
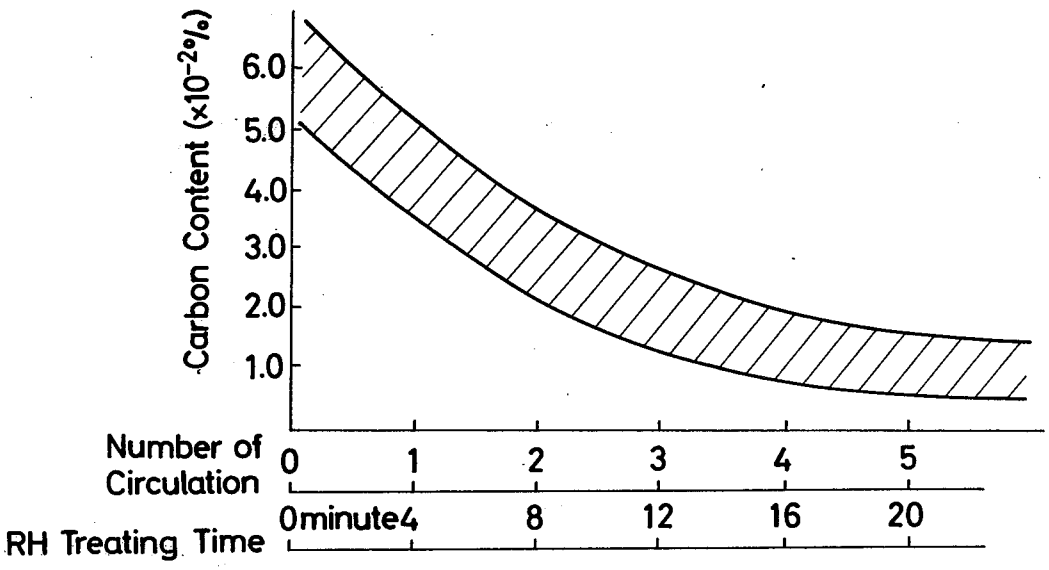
FIG. 4 is a graph showing the relation between the treating time and the carbon content in the molten steel.
Figure 5:
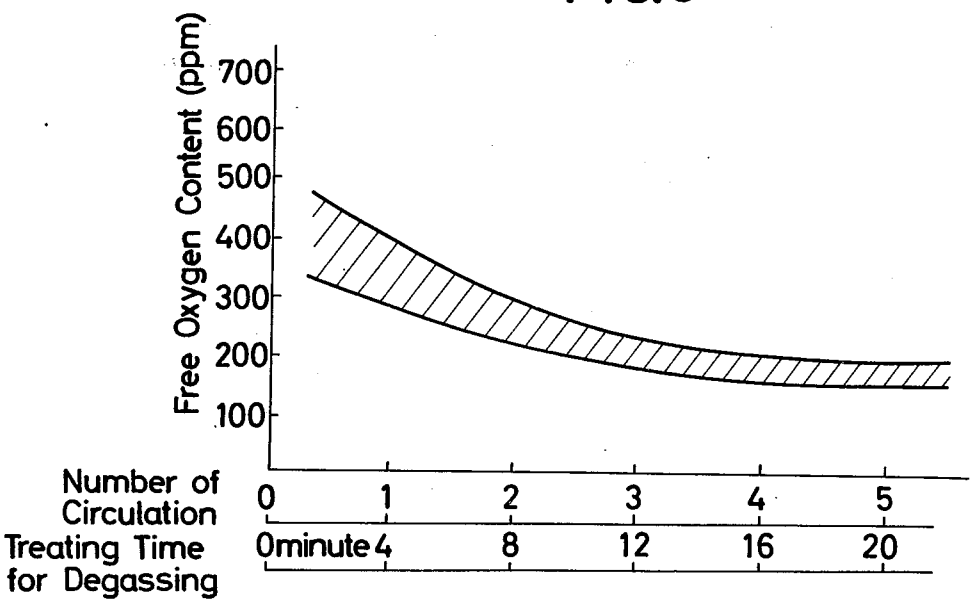
FIG. 5 is a graph showing the relation between the treating time and the free oxygen content in the molten steel.

As described above, if the vacuum degree is adjusted to an appropriate value between 10 and 3000 mmHg corresponding to the progress of the decarburization reaction in the degassing treatment, the behaviour of the carbon content and the free oxygen content in molten steel are as shown in FIGS. 4 and 5 (350 ton heat, 250–10 mmHg, circulation of 87 ton/min.), so that the decarburization reaction is almost complete with 4 circulations due to the smooth and efficient degassing treatment. This reduced number of circulations reduces considerably the amount of metal deposition on the vessel wall and allows completion of the degassing treatment in a very short time.

The term "number of circulation of the molten steel" used in the present invention means the degassing degree and has different meaning when used in connection with the degassing equipment used.

In the case of RH degassing equipment,

| | |
|---|---|
| Number of circulation = | {circulating amount (ton/min.)<br>× treating time (min.)}<br>÷ Treated amount t/charge |

and in case of DH degassing equipment,

| | |
|---|---|
| Number of circulation = | {Amount by one suction<br>(t/one suction)<br>× Number of suctions<br>(No./min.)<br>× Treating time (min.)}<br>÷ Treated amount (t/charge) |

Therefore,

| | |
|---|---|
| Circulation amount in RH = | Amount by one suction<br>× Number of suctions in DH (1) |

In the present invention which is applicable to both RH and DH degassing equipments, the "circulation amount" used herein is a value determined on the basis of the above formula (1).

With less than a one time circulation, since uniform stirring and mixing of the molten steel cannot be achieved, it is impossible to perform the final adjustment of the product composition. On the other hand, with the circulation beyond four times, the deoxidizing efficiency by the CO reaction lowers, so that it is necessary to raise the blow-off temperature of the converter to compensate for the lowering of the molten steel temperature, and thereby the damage to the refractory of the degassing vessel is more serious. This results in increased cost for the degassing treatment, disorder of the time sequence of the continuous casting operation and a considerably elongated treating time.

According to the present invention, Al or Si and other alloying elements required for a final product to be obtained are added during the degassing treatment so as to adjust the steel composition. More specifically, as shown in FIG. 5, when Al or Si and other alloying elements are added at the latter half of the degassing treatment stage where the molten steel contains a low level of free oxygen, a 40 to 65% yield ratio can be achieved for Al and a 75 to 95% yield ratio can be achieved for Si, which are much higher than those obtained by the conventional methods. Also, a higher yield ratio is assured for alloying elements other than that obtained by adding these elements during the pouring or in the ladle according to the conventional methods. Further, the yield ratios for Al, Si and other alloying elements obtained in the present invention show less fluctuation, so that it is possible to adjust the molten steel composition precisely and economically to a predetermined composition, and thereby it is possible to simplify the control of the conditions of the subsequent continuous casting operation. Also it is possible in the present invention to control accurately the temperature after the degassing treatment, thus further simplifying the conditions of the continuous casting operation.

The molten steel prepared by the present invention shows a very high degree of cleanness as compared with those obtained by the conventional methods. For this reason, in the present invention, it is possible to maintain the temperature of the heat in the continuous casting tundish at temperatures only 5° to 30° C. higher than the solidification temperature, and there is no danger of the nozzle clogging problem by the oxide inclusions as seen in the conventional methods.

Figure 6:
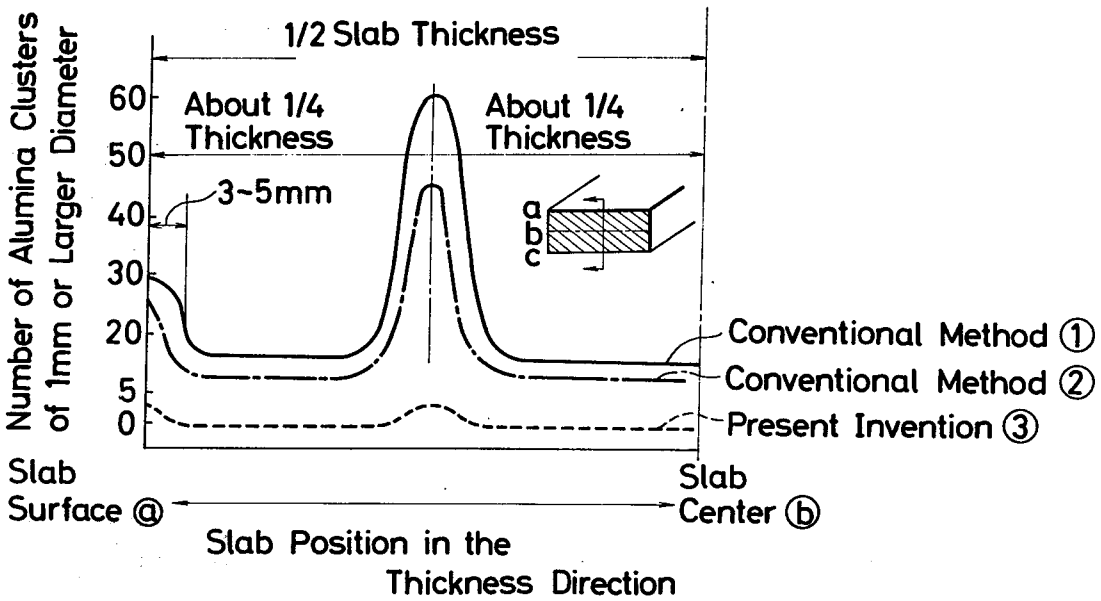
FIG. 6 is a graph showing the cross sectional distribution of oxide inclusions in the slab thickness direction of an Al-killed steel cast by a continuous casting machine of the curved strand type.
Figure 8:
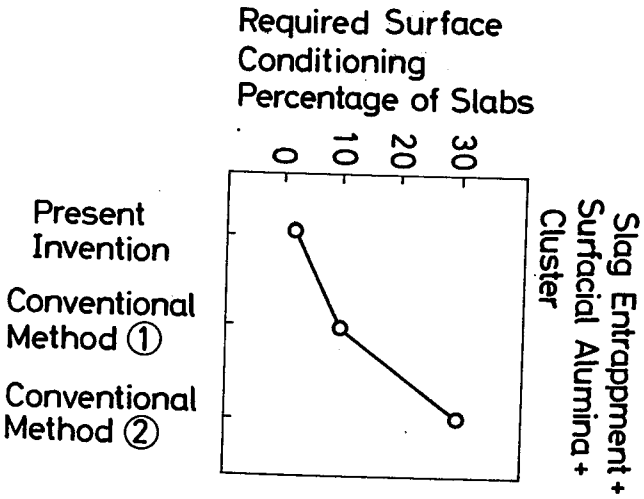
FIG. 8 is a graph showing the slab surface conditioning percentage in comparison with other methods.
Figure 9:
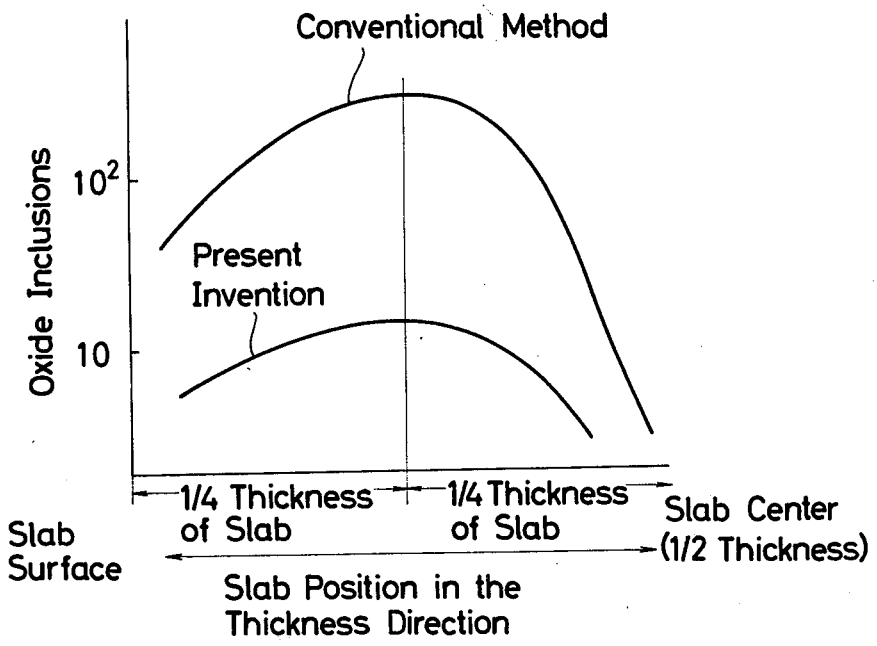
FIG. 9 is a graph showing the cross sectional distribution of oxide inclusions in the slab thickness direction of a Si-killed steel cast by a continuous casting machine of the curved strand type.

Also regarding the cross sectional observation of the slab obtained by the present invention, there is observed almost no segregation of alumina clusters or oxide inclusions, and if any, they are very few as shown by the dotted curve in FIG. 6 and FIG. 9. Thus, a slab having satisfactory inside quality can be obtained by the present invention. Also regarding the surfacial quality, it is possible to considerably improve the surface defects due to the slag or powder entrappment and the surfacial alumina clusters as shown in FIG. 8, because it is possible to maintain an appropriate casting speed which can avoid the surface defects such as the slag or powder entrappment, so that the continuous casting operation can be performed advantageously and smoothly with a high level of productivity.

For the production of Al-Si-killed steels according to the present invention, the main additives, Si and Mn, are added at such a stage that at least 1.5 times of circulation of the molten steel can be assured after the addition in case of the RH vacuum degassing process, or are added in one time or in several times before the molten steel circulates at least 1.5 times in case of the DH vacuum degassing process. Thereafter, the other main additive Al, or Al and other elements required by the final product to be obtained are added (Si or Mn is sometimes added at this stage for fine adjustment of the composition). Thus, regarding the addition of Si and Mn, as understood from FIG. 11 which shows the relation between the addition stage and the occurrence of charges which show more than 20% of nozzle clogging occurrence ratio $$\left(\frac{\text{actual pouring time elongated by the nozzle clogging}}{\text{Standard Pouring Time}} \times 100\right),$$

when the frequency of the molten steel circulation after the addition of Si and Mn is less than 1.5, satisfactory dissolution of the additives and the desired float-up of the oxide inclusions cannot be obtained by circulation and stirring of the molten steel so that a large amount of oxide inclusions and metal inclusions, particularly Al, etc., remains in the steel. Then in the subsequent continuous casting, during the pouring from the ladle to the tundish, the above inclusions adhere to the inside wall of the pouring nozzle to cause nozzle clogging accidents, thus hindering a smooth pouring operation, and hence rendering the continuous casting very unstable and resulting in lowering of the slab quality.

Figure 11:
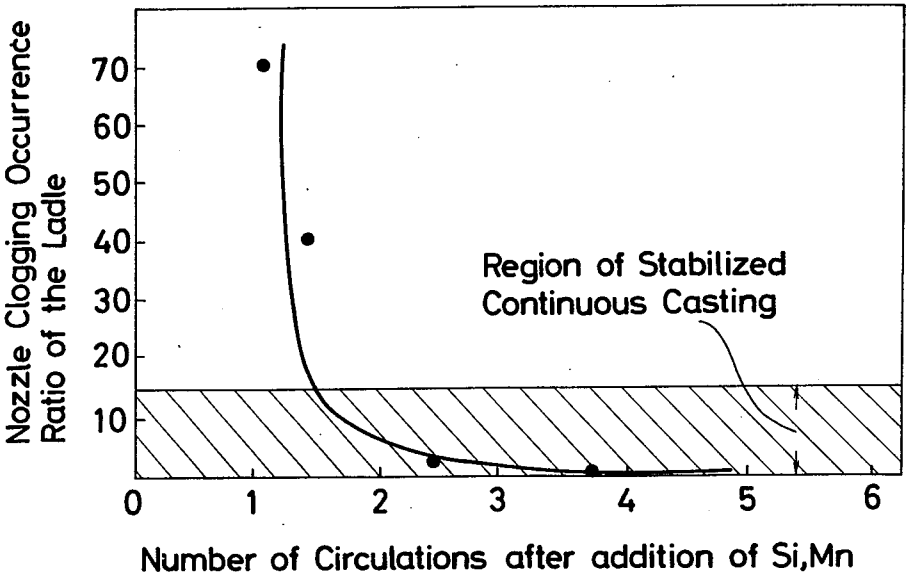
FIG. 11 is a graph showing the relation between the number of circulations after the addition of Si and Mn and the nozzle clogging occurrence.
Figure 12:
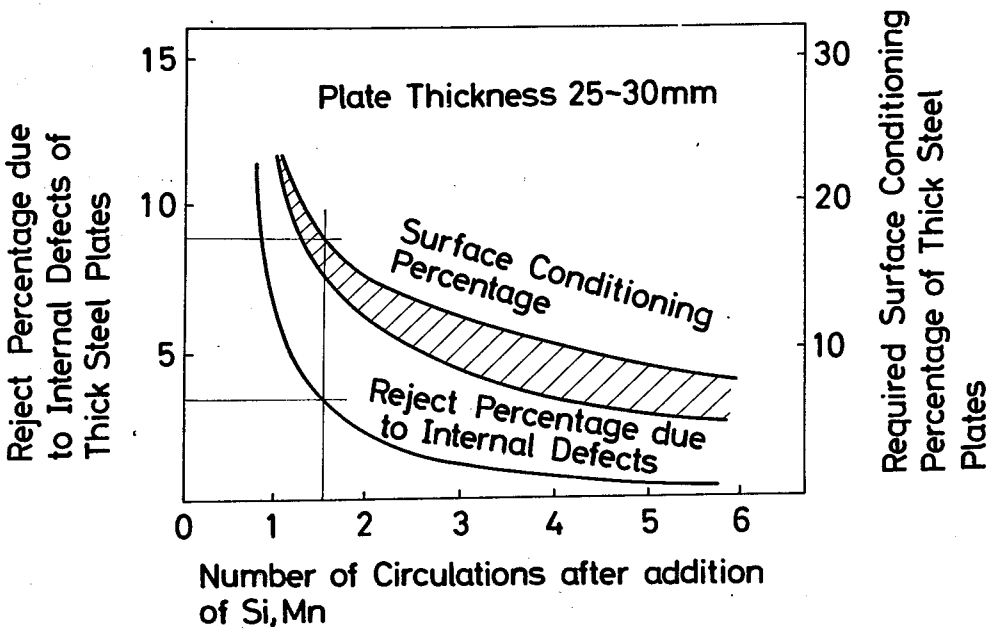
FIG. 12 is a graph showing the relation between the number of circulations after the addition of Si and Mn and the reject percentage due to internal defects of the slab.

For example, when the steel slab obtained above is used for producing a thick steel plate, the reject percentage due to the internal defects detected by ultrasonic testing and the surface conditioning requirement are higher than those in the conventional methods as shown in FIG. 12. This means a lowering of the product yield ratio. Therefore, in the present invention, Si and Mn are added at a stage which assures at least 1.5 times the circulation of molten steel after the addition, thereby the operation is maintained in the stabilized region (15% or lower) as shown in FIG. 11.

Regarding the addition of Al or Al and other elements required by the final product to be obtained, when Al or Al and other elements are added before the addition of Si and Mn, the deoxidation effect mainly by Al is remarkable and the reaction of $[C] + [O] \rightarrow CO$ in the degassing treatment is weakened, so that the removal of H and N by CO gas is hindered. Therefore, in the present invention, Al or Al and other elements are added after the addition of Si and Mn.

Further, according to the present invention, the addition of Mn, Si, Al or Al and other additives in specific stages during the degassing treatment assures the removal of vapor of water contained in the alloying elements during the moving down of Mn and Si, stabilizes addition yield at a high ratio, permits addition of a very small amount of REM, etc., and enables an accurate composition adjustment in a strict range.

As described above, according to the present invention, the operation load of the converter is minimized, and the composition adjustment of the molten steel is achieved accurately by addition of Mn, Si, Al or Al and other additives in an earlier stage under specific degassing conditions which considerably relieves the operation load on the degassing vessel and the ladle.

Further, in the present invention, the yield of the ferro-alloy for composition adjustment is maintained at a high level with less fluctuation so as to minimize the inclusions in the steel and to reduce the amount of H in the steel to the same level as achieved by the conventional high-vacuum degassing treatments. Still further, according to the present invention, the temperature of the molten steel to be supplied to a continuous casting machine is controlled at a very low temperature 5° to 30° C. higher than the solidifying temperature with less fluctuation, and the continuous casting of the molten steel thus obtained can be performed without any nozzle clogging of the ladle.

Therefore, the present invention is advantageous for production of cast products for high quality thick plates and hot rolled steel sheets by a high speed casting and a continuous casting.

Hereinbelow the equipment used in the above described process of the present invention is described.

Figure 13:
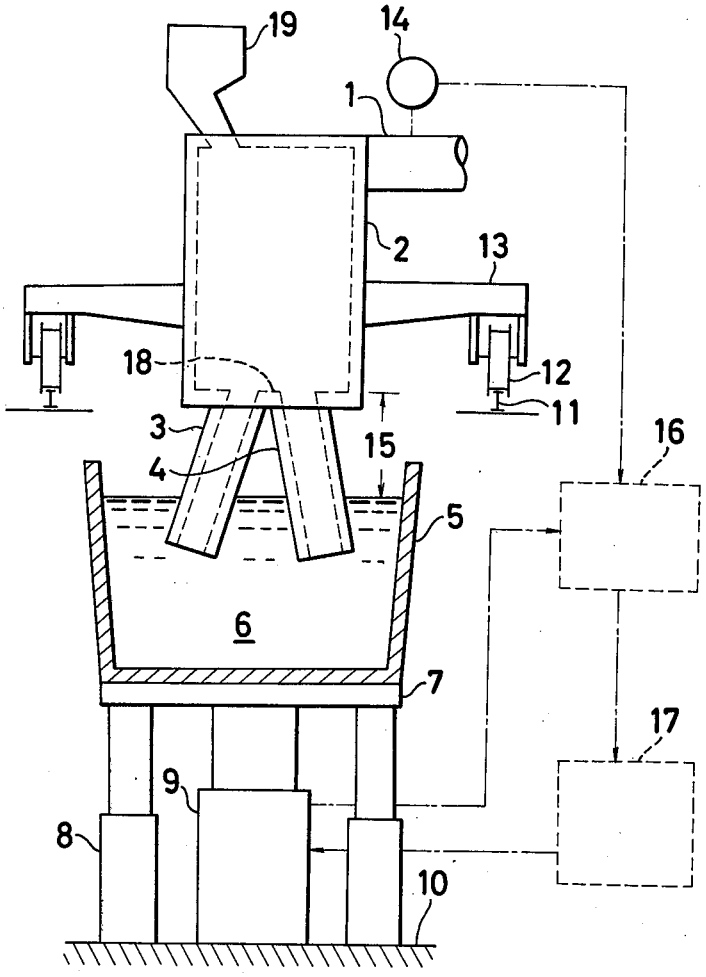
FIGS. 13 and 14 illustrate embodiments of RH vacuum degassing equipment used in the present invention.

Referring to FIG. 13, 1 is an exhaust pipe connected to a vacuum exhausting system, 2 is a degassing vessel, 3 is an upward pipe, 4 is a downward pipe, 5 is a receptacle for molten metal 6, 7 is a base for the receptacle 5, 19 is a device for ferro-alloy addition. In this illustration, the base 7 is provided with an upward guide 8 and a lifting hydraulic cylinder 9, and is arranged on a floor 10.

The degassing vessel 2 is supported by a truck 13 movably supported on rails 11 by means of wheels 12, and the exhauster pipe is provided with a vacuum detector 14, which measures the degree of vacuum in the degassing vessel. Then the distance 15 between the upper surface of the molten metal 6 in the receptacle 5 corresponding to the vacuum degree in the degassing vessel 2 and the path surface 18 on which the molten metal can circulate in the degassing vessel is memorized beforehand by a comparison control device 16, and the value measured by the detector 14 is introduced to the control device 16 to compare the memorized distance with the measured value and produces an output of a required distance $15_{-1}$ - $15_{-n}$ to the oil-pressure supplying device 17.

Then the oil-pressure supplying device 17 drives the hydraulic cylinder 9 so as to maintain the above required distance $15_{-1}$ - $15_{-n}$. The operational distance at this time is corrected and controlled in correspondence to the "excessive" and "short" signals sent from a distance measuring device (not shown) provided on the hydraulic cylinder to the comparison control device 16.

In the above embodiment, the receptacle 5 itself is illustrated to move up and down. However, a lifting device for the degassing vessel 2 may be provided on the truck 13 so as to obtain a similar operation as above, or both of the degassing vessel 2 and the receptacle 5 may be designed to move up and down.

Further, the comparison control device 16 may be designed so as to indicate the vacuum degree in the degassing vessel 2 and to operate the oil-pressure supplying device on the basis of the above relation.

Figure 14:
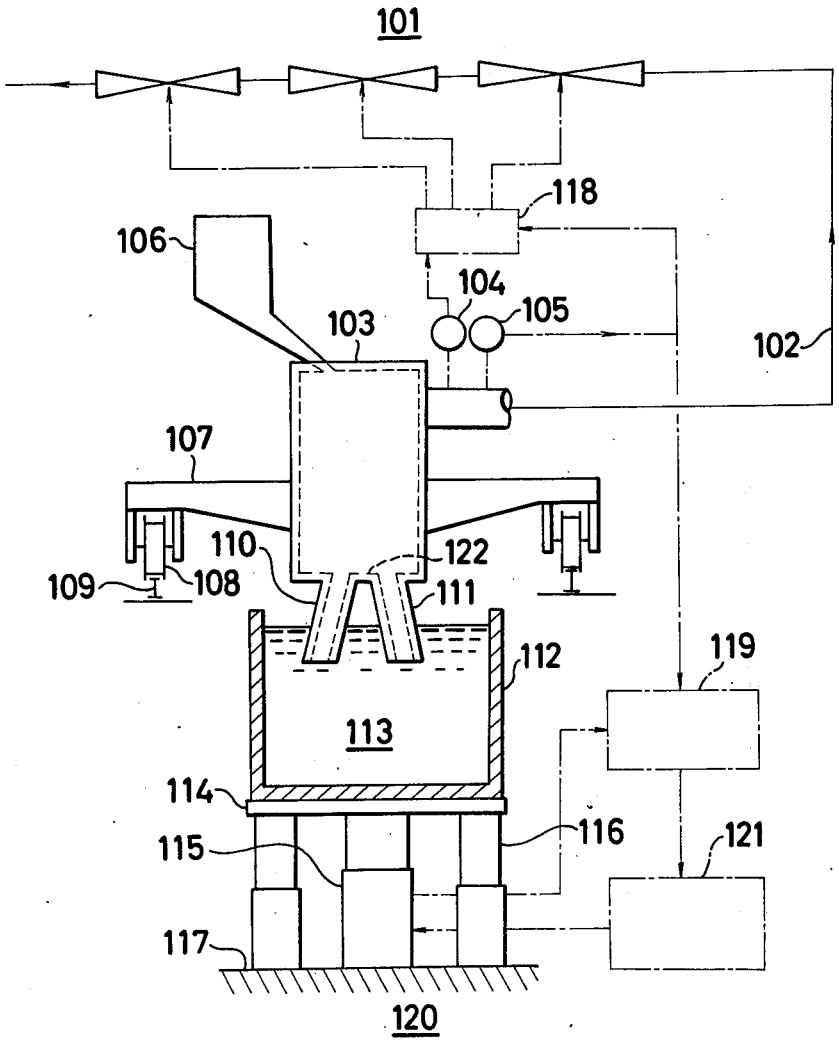

Another embodiment of the degassing equipment used in the present invention is illustrated in FIG. 14, in which 101 is an exhauster comprising a plurality of steam ejectors, 102 is an exhaust pipe connecting between the degassing vessel 103 and the exhauster 101, 104 is a detector for detecting the decarburization degree in the degassing vessel, which is composed of a gas analyser, a carbon concentration counter and a gas-flow meter, 105 is a vacuum detector for detecting the vacuum degree in the degassing vessel, 106 is a ferro-alloy addition device, 107 is a truck supporting the degassing vessel 103, 108 is a wheel, 109 is a rail, 110 is an upward pipe, 111 is a downward pipe, 112 is a receptacle for the molten metal 113, 114 is a support base, 115 is a lifting device, such as, a hydraulic cylinder for the support base 114, 116 is a guide for the support base 114, 117 is the floor, 118 is an instruction device for instructing the vacuum degree, 119 is a distance instructing device, and 120 is a device for maintaining a required distance comprising the oil-pressure supplying device 121 and the lifting device 115.

In the above illustrated embodiment, the operational instructions are given to the vacuum instruction device 118 at the time of starting the degassing treatment.

The operational instructions are classified into items of the steel grade, the deoxidation degree, the steel composition and the treating conditions. The vacuum instruction device 118 is given information of the relation between the decarburization degree in the degassing vessel 103 and the predetermined vacuum degree for each item of the operational instructions.

Thus, the exhauster 101 operates under the conditions instructed by the operational instruction to increase the vacuum degree in the degassing vessel 103 and at the same time, a vacuum degree according to the items of the operational instructions is maintained on the basis of the measured value from the decarburization detector 104 of the degassing vessel 103.

At this stage, the vacuum degree in the degassing vessel 103 is input always from the detector 105 to the vacuum instruction device 118, and compared with a predetermined value. Then a compensation instruction is output to the exhauster to maintain the predetermined value.

Under this state, the vacuum detector 105 continues to output the signal of the vacuum degree in the degassing vessel 103 to the distance instructing device 119.

The distance instructing device 119 is given beforehand a predetermined positional relation of the surface 122 of the circulation path of the molten metal between the upward pipe 110 and the downward pipe 111, and the information of required distance is output to the oil-pressure supplying device 121 on the basis of the output of the vacuum detector 105, thereby the lifting device 115 maintains the required distance.

Also the information of the actual position of the lifting device 122 is input to the distance instructing device 119 from a distance measuring device (not shown) provided on the lifting device 112 so as to adjust the position of the lifting device 122 in correspondence to the excessiveness or shortness of the required distance.

In this embodiment also, the receptacle 112 itself is illustrated to move up and down. However, a lifting device for the degassing vessel 103 may be provided on the truck 107 so as to obtain a similar operation as above or both of the degassing 103 and the receptacle 112 may be designed to move up and down. Further, as the lifting device 115, a motor may be used instead of the hydraulic cylinder.

According to the device as illustrated above, it is possible to prevent undue splash of the molten metal during its circulation under a high degree of vacuum so that a desired operation can be achieved, and it is also possible to maintain enough circulation of the molten metal even under a low degree of vacuum. Further, in case of treatment of non-oxidized or semi-oxidized molten metal, it is possible to adjust the vacuum degree in the degassing vessel from a low level to a high level in correspondence to the progress of deoxidation and decarburization of the molten metal and to maintain a required distance which assures a desirable circulation condition. Therefore, an efficient and smooth treatment of the molten metal can be achieved.

Figure 15:
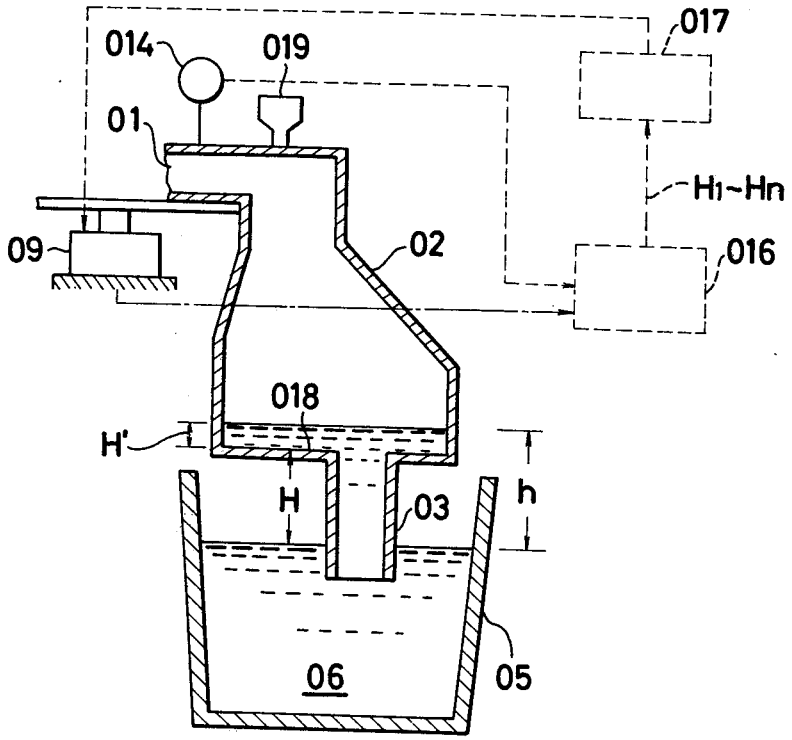
FIG. 15 illustrates an embodiment of a DH vacuum degassing equipment used in the present invention.

The embodiment shown in FIG. 15 is of the DH vacuum degassing type. Generally in case of the DH vacuum degassing process, the vacuum degree is maintained at a constant value of about 1 mmHg so that the suction-up height of molten steel is constant and hence the amount of molten steel sucked up into the degassing vessel is constant.

In the present invention utilizing the DH degassing process, the vacuum degree is varied as the degassing treatment proceeds to that the height of molten steel raised by the vacuum is not constant and hence the amount of molten steel raised up varies. Thus, in order to maintain the amount of molten steel raised by the vacuum at a constant value, the vacuum degree is measured to determine the depth of the molten steel in the degassing vessel which assures a predetermined height of the column of molten steel as well as a predetermined amount of the molten steel to be raised up, and the stroke of the upward and downward movement of the degassing vessel is controlled.

In FIG. 15, 01 is an exhaust pipe connected to the vacuum exhausting system, 02 is a degassing vessel, 03 is a suction-up pipe, 05 is a receptacle for the molten metal 06, and 019 is a device for adding ferro-alloys. In this embodiment, the degassing vessel is moved up and down by means of a hydraulic cylinder 09, and a detector 014 for measuring the vacuum degree in the degassing vessel 02 is provided on the exhaust pipe 01.

Then, the height H of the bottom of the degassing vessel 02 which is obtained by subtracting the depth H' of the molten steel in the degassing vessel 02 necessary for raising up a predetermined amount of molten steel into the vessel 02 for degassing from the raised-up height h of molten steel corresponding to the vacuum degree in the vessel (thus $H = h - H'$) is memorized beforehand in a comparison control device 16. The value measured by detector 014 is introduced into the comparison control device 016 to compare it with the memorized information and to output a required distance $H_1$ - $H_n$ to an oil pressure supplying device 017, which drives the hydraulic cylinder 09 to move up or down the degassing vessel so as to maintain the required distance $H_1$ - $H_n$. The operation distance of the hydraulic cylinder at this time is controlled on the basis of the "excessive" or "short" signal sent to the comparison control device 016 from a distance measuring device (not shown) provided on the hydraulic cylinder.

The present invention is further disclosed in the following embodiments.

EXAMPLE 1

355 tons of molten pig iron consisting of 4.5% C, 0.60% Si, 0.60% Mn, 0.100% P, 0.020% S with the balance being iron were charged to a converter, and the blowing was performed for 15 minutes to obtain a molten steel having the blow-off composition and temperature and a slag composition as shown in Table 1. Then the molten steel thus obtained was poured into a ladle with no addition of ferro-alloy during the pouring and subsequently transferred to a RH type vacuum degassing vessel where the molten steel was treated under a vacuum degree provided by a vacuum generator within a range from 250 to 25 mmHg while stepwisely adjusting the vacuum degree within the range corresponding to the decarburization degree of the molten steel as shown in FIG. 2(*b*). During the degassing treatment, the splashing was well controlled within the smooth operation zone, and the treatment was completed in 16 minutes with 4 circulations. Alloying elements were added at the 14 minute point in an amount shown in Table 1. Then the molten steel thus adjusted in its composition was continuously cast by a continuous casting machine of the curved strand type under the conditions shown in Table 1. The results were that there was almost no trouble of the nozzle clogging during the casting operation and an Al-killed steel suitable for cold rolling, having very excellent surfacial quality and being completely free from internal defects, was obtained.

EXAMPLE 2

300 tons of molten pig iron consisting of 4.5% C, 0.60% Si, 0.60% Mn, 0.100% P, 0.02% S, with the balance being iron and 55 tons of scrap were charged to a converter and the blowing was performed for 15 minutes to obtain the blow-off steel composition and temperature and the slag composition shown in Table 1, and a small amount of high-carbon Fe-Mn (1.5 kg/ton of molten steel) alone was added during the pouring from the converter to a ladle. Then the molten steel was transferred to a RH type vacuum degassing vessel where the molten steel was treated under a vacuum degree provided by a vacuum generator within a range 150 to 10 mmHg while stepwisely adjusting the vacuum degree within the range in correspondence to the decarburization degree of the molten steel as shown in FIG. 2(*b*).

During the degassing treatment, the splashing was well controlled within the smooth operation zone and the treatment was completed in 12 minutes with 3.0 circulations.

Alloying elements were added at the 10 minute point in an amount shown in Table 1 to adjust the composition as shown in Table 1. The molten steel thus adjusted in its composition was continuously adjusted by a continuous casting machine of the curved strand type under the conditions shown in Table 1. The results were that there was almost no nozzle clogging during the casting operation and an Al-killed steel suitable for hot rolled medium gauge steel plates as excellent that produced in Example 1 was obtained.

EXAMPLE 3

245 tons of molten pig iron consisting of 4.5% C, 0.65% Si, 0.55% Mn, 0.100% P, 0.02% S, with the balance being iron and 26 tons of scrap were charged to a converter, and the blasting was performed for 16 minutes to obtain the blow-off steel composition and temperature and the blow-off slag composition shown in Table 1. The molten steel thus obtained was poured to a ladle with no addition of ferro-alloy during the pouring and subsequently transferred to a DH vacuum degassing vessel where the molten steel was degassed by suction-up under a vacuum degree provided by a vacuum generator within a range of from 150 to 10 mmHg while stepwisely adjusting the vacuum degree in correspondence to the decarburization degree of the molten steel, and adjusting the height of the degassing vessel. During the degassing treatment, the splashing was well controlled within the smooth operation zone and the treatment was completed in 12 minutes with 3.5 circulations.

Alloying elements were added at the 10 minute point in an amount shown in Table 1 to adjust the steel composition. The molten steel thus adjusted was continuously cast by a continuous casting machine of curved strand type under the conditions shown in Table 1. The results were that there was almost no nozzle clogging during the casting and Al-killed hot rolled medium gauge steel plates as excellent as in Example 1 were obtained.

COMPARISON 1

Figure 7:
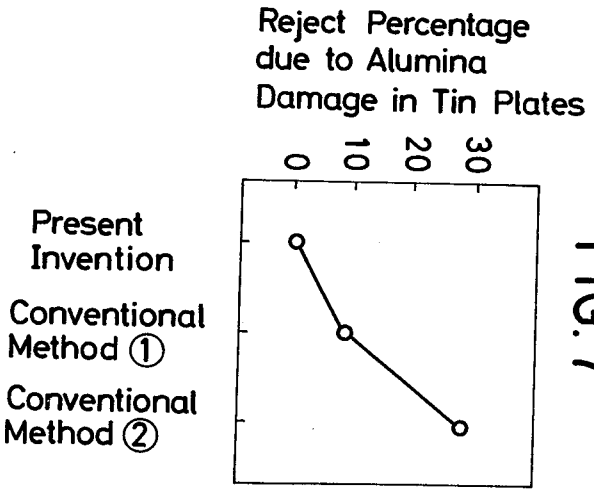
FIG. 7 is a graph showing the reject percentage due to alumina clusters in the production of tin plates in comparison with the conventional methods.

355 tons of molten pig iron consisting of 4.5% C, 0.60% Si, 0.60% Mn, 0.100% P, 0.020% S, with the balance being iron were charged to a converter, and the blowing was performed for 15 minutes to obtain a molten steel having the blow-off composition and temperature and a slag composition as shown in Table 1. Then the molten steel thus obtained was poured to a ladle with addition of 2.8 kg/t of low-carbon Fe-Mn and 2.5 kg/t of Al during the pouring to adjust the composition, and the molten steel thus adjusted was supplied to a continuous casting machine of curved strand type to obtain Al-killed steel for cold rolling. The tundish temperature in this comparison was set at 1557° C. which was 14° C. higher than that in the present invention, and in spite of this higher tundish temperature the nozzle clogging due to the alumina inclusions occurred very often during the casting, and it was impossible to achieve a casting speed higher than 1.2 m/min. The internal defects and the surfacial quality of the products obtained by this comparison method were considerably inferior to the products of the present invention as shown in FIG. 7 and FIG. 8.

EXAMPLE 4

355 tons of molten pig iron consisting of 4.4% C, 0.60% Si, 0.60% Mn, 0.100% P, 0.025% S, with the balance being iron were charged into a converter, and the blasting was performed for 15 minutes to obtain the blow-off composition and temperature and a blow-off slag composition as shown in Table 2. Then the molten steel thus obtained was poured to a ladle with addition of a small amount (2.6 kg/t) of high-carbon Fe-Mn alone during the pouring and subsequently transferred to a RH type vacuum degassing vessel where the molten steel was treated under a vacuum degree provided by a vacuum generator within a range of from 250 to 20 mmHg while stepwisely adjusting the vacuum degree within the range in correspondence to the decarburization degree of the molten steel in such a pattern as: in the first 5 minute period in a range of from 250 to 200 mmHg; in the second 5 to 13 minute period in a range of from 200 to 50 mmHg; and in the third 13 to 16 minute period in a range of from 50 to 20 mmHg. The splashing during the treatment was well controlled within the smooth operation zone, and the treatment was completed in 16 minutes with 4.0 circulation. The alloying elements were added between the 14 minute point and the 16 minute point in an amount shown in Table 2 to obtain the adjusted composition also shown in Table 2. Then, the molten steel thus obtained was continuously cast by a continuous casting machine of curved strand type under the conditions shown in Table 2. The results were that there was almost no trouble of the nozzle clogging during the casting operation and an Al-killed steel suitable for cold rolling containing remarkably less inside oxide inclusions and having very excellent surfacial quality was obtained.

EXAMPLE 5

300 tons of molten pig iron consisting of 4.5% C, 0.55% Si, 0.60% Mn, 0.150% P, 0.02% S, with the balance being iron and 55 tons of scrap were charged to a converter, and the blasting was performed for 15 minutes to obtain the blow-off steel composition and temperature and the blow-off slag composition as shown in Table 2, and a small amount (2.6 kg/t) of high-carbon Fe-Mn alone was added during the pouring to a ladle. Then the molten steel was transferred to a RH vacuum degassing vessel where the molten steel was treated under a vacuum degree provided by a vacuum generator within a range of from 250 to 30 mmHg, while stepwisely adjusting the vacuum degree within the range in correspondence to the decarburization degree of the molten steel in such a pattern as: in the first 5 minute period in a range of from 250 to 150 mmHg; in the second 5 to 9 minute period in a range of from 150 to 50 mmHg; and in the third 9 to 12 minute period in a range of from 50 to 30 mmHg. During the degassing treatment, the splashing was well controlled within the smooth operation zone and the treatment was completed in 12 minutes with 3.0 circulations.

Alloying elements were added between the 10 minute point and the 12 minute point in an amount shown in Table 2 to adjust the composition as shown in Table 2. The molten steel thus adjusted was continuously cast by a continuous casting machine of curved strand type under the conditions shown in Table 2. The results were that there was almost no nozzle clogging during the casting operation, and Si-killed steel for cold rolling as excellent as the steels in Example 4 were obtained.

EXAMPLE 6

355 tons of molten pig iron consisting of 4.5% C, 0.60% Si, 0.60% Mn, 0.100% P, 0.020% S, with the balance being iron were charged to a converter and the blowing was performed for 15 minutes to obtain the blow-off steel composition and temperature and the blow-off slag composition shown in Table 2. Then the molten steel thus obtained was poured to a ladle with addition of a small amount (1.5 kg/t) of high-carbon Fe-Mn alone during the pouring, and subsequently transferred to a RH vacuum degassing vessel where the molten steel was treated under a vacuum degree provided by a vacuum generator within a range of from 210 to 15 mmHg, while stepwisely adjusting the vacuum degree within the range in correspondence to the decarburization degree of the molten steel in such a pattern as: in the first 4 minute period in a range of from 210 to 150 mmHg; in the second 4 to 7 minute period in a range of from 150 to 100 mmHg; and in the third 7 to 13 minute period in a range of from 100 to 15 mmHg. During the degassing treatment the splashing as well controlled within the smooth operation zone and the treatment was completed in 13 minutes with 3.25 circulations.

Alloying elements were added at a point between the 7 minute point and the 13 minute point in an amount as shown in Table 2 to adjust the composition. The molten steel thus adjusted was continuously cast by a continuous casting machine of curved strand type under the conditions shown in Table 2. The results were that there was almost no nozzle clogging during the casting operation and Si-killed steels for hot rolling as excellent as that obtained in Example 4 was obtained.

EXAMPLE 7

300 tons of molten pig iron consisting of 4.5% C, 0.60% Si, 0.60% Mn, 0.100% P, 0.02% S, with the balance being iron and 55 tons of scrap were charged to a converter and the blowing was performed for 17 minutes to obtain the blow-off steel composition and temperature and the blow-off slag composition as shown in Table 2. Then the molten steel was poured to a ladle without addition of ferro-alloy during the pouring and subsequently transferred to a RH vacuum degassing vessel where the molten steel was treated under a vacuum degree provided by a vacuum generator within a range of from 190 to 20 mmHg, while stepwisely adjusting the vacuum degree within the range in correspondence to the decarburization degree of the molten steel in such a pattern as: in the first 4 minute period in a range of from 190 to 150 mmHg; in the second 4 to 8 minute period in a range of from 150 to 100 mmHg; and in the third 8 to 14 minute period in a range of from 100 to 20 mmHg. During the degassing treatment, the splashing is well controlled within the smooth operation zone, and the treatment was completed in 14 minutes with 3.5 circulations.

Alloying elements were added at a point between the 8 minute point and the 14 minute point in an amount as shown in Table 2 to adjust the composition. The molten steel thus adjusted was continuously cast by a continuous casting machine of curved strand type under the conditions as shown in Table 2. The results were that there was almost no nozzle clogging during the casting operation and Si-killed steels suitable for hot rolling as excellent as those obtained in Example 4 were obtained.

EXAMPLE 8

245 tons of molten pig iron consisting of 4.5% C, 0.65% Si, 0.55% Mn, 0.100% P, 0.02% S with the balance being iron and 26 tons of scrap were charged to a converter and the blowing was performed for 17 minutes to obtain the blow-off steel composition and temperature and the blow-off slag composition as shown in Table 2. Then the molten steel was poured to a ladle without addition of ferro-alloy during the pouring and subsequently transferred to a DH vacuum degassing vessel where the molten steel was degassed by suction-up under a vacuum degree provided by a vacuum generator within a range of from 190 to 20 mmHg, while stepwisely adjusting the vacuum degree within the range in correspondence to the decarburization degree of the molten steel in such a pattern as: in the first 4 minute period in a range of from 190 to 150 mmHg; in the second 4 to 8 minute period in a range of from 150 to 100 mmHg; in the third 8 to 13 minute period in a range of from 100 to 20 mmHg and adjusting the height of the DH vacuum degassing vessel. During the degassing treatment the splashing was well controlled within the smooth operation zone, and the treatment was completed in 13 minutes with 3.7 circulations.

Alloying elements were added at a point between the 7 minute point and the 13 minute point in an amount as shown in Table 2 to adjust the composition. The molten steel thus adjusted was continuously cast by a continuous casting machine under the conditions as shown in Table 2. The results were that there was almost no nozzle clogging during the casting operation and Si-killed steels suitable for hot rolling as excellent as those obtained in Example 4 were obtained.

COMPARISON 2

Figure 10:
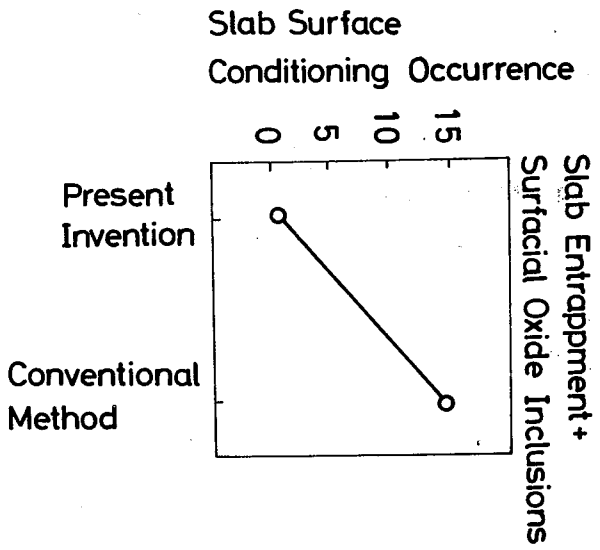
FIG. 10 is a graph showing the slab conditioning percentage in comparison with a conventional method.

355 tons of molten pig iron consisting of 4.3% C, 0.55% Si, 0.65% Mn, 0.095% P, 0.015% S and the balance being iron were charged to a converter, and the blowing was performed for 15 minutes to obtain the blow-off steel composition and temperature and the blow-off slag composition as shown in Table 2. Then the molten steel thus obtained was poured to a ladle with addition of 3.86 kg/t of low-carbon Fe-Mn, 0.94 kg/t of Fe-Si and 0.43 kg/t of Al during the pouring to adjust the composition finally. The molten steel thus adjusted was supplied to a continuous casting machine to produce a Si-killed steel for cold rolling. Although the tundish temperature in this comparison method was maintained 12 to 17° C. higher than that in the present invention, the nozzle clogging due to the oxide inclusions occurred very often during the casting, and it was impossible to maintain the casting speed higher than 1.2 m/min. The internal defects and the surfacial quality of the product of this comparison methods are considerably inferior to those of the present invention as shown in FIG. 9 and FIG. 10.

COMPARISON 3

355 tons of molten pig iron consisting of 4.5% C, 0.60% Si, 0.60% Mn, 0.100% P, 0.020% S with the balance being iron were charged to a converter and the blasting was performed for 15 minutes to obtain the blow-off steel composition and temperature and the blow-off slag composition as shown in Table 2. Then the molten steel was poured to a ladle with addition of 6.29 kg/t of high-carbon Fe-Mn during the pouring, addition of 2.04 kg/t of Fe-Si and 0.10 kg/t of Al after the pouring to the molten steel with stirring under a non-oxidizing atmosphere to adjust the steel composition finally. Then the molten steel thus adjusted was supplied to a continuous casting machine of curved strand type to produce a Si-killed steel for hot rolling.

Although the tundish temperature in this comparison method was maintained 8 to 10° C. higher than that in the present invention, the nozzle clogging due to the oxide inclusions occurred very often during the casting operation, and it was impossible to maintain the casting speed higher than 1.2 m/min. The internal defects and the surfacial quality of the product obtained by this comparison method were as bad as those in Comparison 2 and considerably inferior to those obtained by the present invention.

EXAMPLE 9

355 tons of molten pig iron consisting of 4.40% C, 0.45% Si, 0.65% Mn, 0.100% P, 0.020% S, with the balance being iron were charged to a converter, and the blowing was performed for 15 minutes to obtain the blow-off steel composition and temperature and the blow-off slag composition as shown in Table 3. Then the molten steel was poured to a ladle without addition of ferro-alloy during the pouring and transferred to a RH vacuum degassing vessel where the molten steel was treated under a vacuum degree provided by a vacuum generator within a range of from 250 to 10 mmHg, while stepwisely adjusting the vacuum degree in correspondence to the decarburization degree of the molten steel in such a pattern as:in the first 4 minute period in a range of from 250 to 150 mmHg; in the second 4 to 7 minute period in a range of from 150 to 100 mmHg; in the third 7 to 11 minute period at 60 mmHg; and in the fourth 11 to 18 minute period at 10 mmHg.

Alloying elements were added during the degassing treatment in amounts as shown Table 3 and then the molten steel was continuously cast by a continuous casting machine under the conditions shown in Table 3. The results were that there was almost no nozzle clogging both in the ladle and the tundish during the casting, and an Al-Si-killed steel having less internal defects and excellent surfacial quality was obtained, and as shown in the item of the slab analysis in Table 3, the level of H content in the steel thus obtained was well within the allowable range. The steel was suitable for production of thick steel plates of 40 kg/mm$^2$ tensile strength.

EXAMPLE 10

355 tons of molten pig iron consisting of 4.45% C, 0.50% Si, 0.55% Mn, 0.098% P, 0.020% S with the balance being iron were charged to a converter and the blowing was performed for 16 minutes to obtain the blow-off steel composition and temperature and the blow-off slag composition as shown in Table 3. The molten steel thus obtained was transferred to a ladle with addition of a small amount (2.9 kg/t) of Fe-Mn during the pouring, and subsequently the molten steel was transferred to a RH vacuum degassing vessel where the molten steel was treated under a vacuum degree provided by a vacuum generator in a range of from 300 to 10 mmHg, while stepwisely adjusting the vacuum degree in correspondence to the decarburization degree of the molten steel in such a pattern as: in the first 4 minute period in a range of from 300 to 150 mmHg; in the second 4 to 11 minute period in a range of from 100 to 60 mmHg; and in the third 11 to 18 minute period at 10 mmHg. Alloying elements were added during the degassing treatment in amounts as shown in Table 3. Then the molten steel was continuously cast by a continuous casting machine of curved strand type under the conditions as shown in Table 3. The results were that there was almost no nozzle clogging of the ladle and the tundish during the casting, and an Al-Si-killed steel having less internal defects and excellent surfacial quality was obtained, and as shown in the item of the slab analysis in Table 3, the level of H content in the steel thus obtained was well within the allowable range. The steel was suitable for production of thick steel plates of 40 kg/mm$^2$ tensile strength.

EXAMPLE 11

355 tons of molten pig iron consisting of 4.40% C, 0.45% Si, 0.55% Mn, 0.110% P, 0.015% S with the balance being iron were charged to a converter and the blowing was performed for 17 minutes to obtain the blow-off steel composition and temperature, and the blow-off slag composition as shown in Table 3, the molten steel thus obtained was poured to a ladle with addition of a small addition (2.9 kg/t) of Fe-Mn during the pouring, and subsequently transferred to a RH vacuum degassing vessel where the molten steel was treated under a vacuum degree provided by a vacuum generator within a range of from 300 to 10 mmHg, while adjusting the vacuum degree in correspondence to the decarburization degree of the molten steel in such a pattern as: in the first 4 minute period in a range of from 300 to 150 mmHg; in the second 4 to 11 minute period in a range of from 100 to 60 mmHg; and in the third 11 to 18 minute period at 10 mmHg. Alloying elements were added during the degassing treatment in amounts as shown in Table 3 and the molten steel thus obtained was continuously cast by a continuous casting machine or curved strand type under the conditions as shown in Table 3. The results were that there was almost no nozzle clogging of the ladle and the tundish during the casting, and an Al-Si-killed steel having less internal defects and excellent surfacial quality was obtained, and as shown in the item of the slab analysis in Table 3, the level of H content in the steel thus obtained was well within the allowable range. The steel was suitable for production of thick steel plates of 50 kg/mm$^2$ tensile strength.

EXAMPLE 12

355 tons of molten pig iron consisting of 4.40% C, 0.40% Si, 0.55% Mn, 0.105% P, 0.020% S, with the balance being iron were charged to a converter, and the blowing was performed for 15 minutes to obtain the blow-off steel composition and temperature and the blow-off slag composition as shown in Table 3. The molten steel thus obtained was poured to a ladle with addition of a small amount (2.9 kg/t) of Fe-Mn during the pouring, and subsequently transferred to a RH vacuum degassing vessel where the molten steel was treated under a vacuum degree provided by a vacuum generator within a range of from 300 to 10 mmHg, while stepwisely adjusting the vacuum degree in correspondence to the decarburization of the molten steel in such a pattern as: in the first 4 minute period in a range of from 300 to 150 mmHg; in the second 4 to 11 minute period in a range of from 100 to 60 mmHg; in the third 11 to 18 minute period at 10 mmHg. Alloying elements were added during the degassing treatment in amounts as shown in Table 3 and the molten steel thus obtained was continuously cast by a continuous casting machine of curved strand type under the conditions shown in Table 3. The results were that there was almost no nozzle clogging of the ladle and the tundish during the casting, and an Al-Si-killed steel having less internal defects and excellent surfacial quality was obtained, and as shown in the item of the slab analysis, the level of H content in the steel was well within the allowable range. The steel thus obtained was suitable for production of thick steel plates of 40 kg/mm$^2$ tensile strength.

EXAMPLE 13

355 tons of molten pig iron consisting of 4.45% C, 0.50% Si, 0.55% Mn, 0.103% P, 0.022% S with the balance being iron was poured to a converter, and the blasting was performed for 15 minutes to obtain the blow-off steel composition and temperature and the blow-off slag composition as shown in Table 3. The molten steel thus obtained was poured to a ladle with addition of a small amount (2.9 kg/t) of Fe-Mn during the pouring, and subsequently transferred to a RH vacuum degassing vessel where the molten steel was treated under a vacuum degree provided by a vacuum generator within a range of from 300 to 10 mmHg, while stepwisely adjusting the vacuum degree in correspondence to the decarburization degree of the molten steel in such a pattern as: in the first 4 minute period in a range of from 300 to 150 mmHg; in the second 4 to 11 minute period in a range of from 100 to 60 mmHg; and the third 11 to 18 minute period at 10 mmHg. Alloying elements were added during the degassing treatment in amounts as shown in Table 3, and the molten steel thus obtained was continuously cast by a continous casting machine of curved strand type under the conditions as shown in Table 3. The results were that there was almost no nozzle clogging of the ladle and the tundish during the casting and an Al-Si-killed steel having less internal defects and excellent surfacial quality was obtained, and as shown in the item of the slab analysis in Table 3, the level of H content in the steel was well within the allowable range. The steel thus obtained was suitable for production of thick steel plates of 40 kg/mm$^2$ tensile strength.

EXAMPLE 14

355 tons of molten pig iron consisting of 4.40% C, 0.52% Si, 0.50% Mn, 0.100% P, 0.020% S, with the balance being iron was charged to a converter and the blowing was performed for 15 minutes to obtain the blow-off steel composition and temperature and the blow-off slag composition as shown in Table 3. The molten steel thus obtained was poured to a ladle with no addition of ferro-alloy during the pouring, and subsequently transferred to a RH vacuum degassing vessel where the molten steel was treated under a vacuum degree provided by a vacuum generator within a range of from 300 to 10 mmHg, while stepwisely adjusting the vacuum degree in correspondence to the decarburization degree of the molten steel in such a pattern as: in the first 4 minute period in a range of from 300 to 150 mmHg; in the second 4 to 11 minute period in a range of from 100 to 60 mmHg; and in the third 11 to 18 minute period at 10 mmHg. Alloying elements were added during the degassing treatment in amounts as shown in Table 3, and the molten steel thus obtained was continuously cast by a continuous casting machine of curved strand type under the conditions shown in Table 3. The results were that there was almost no nozzle clogging of the ladle and the tundish during the casting, and an Al-Si-killed steel having less internal defects and excellent surfacial quality was obtained, and as shown in the item of the slab analysis in Table 3 the level of H content in the steel was well within the allowable range. The steel thus obtained was suitable for production of steel pipes.

EXAMPLE 15

271 tons of molten pig iron consisting of 4.45% C, 0.65% Si, 0.55% Mn, 0.098% P, 0.020% S, with the balance being iron were charged to a converter and the blowing was performed for 16 minutes to obtain the blow-off steel composition and temperature and the blow-off slag composition as shown in Table 3. The molten steel thus obtained was poured to a ladle with addition of a small amount (2.9 kg/t) of Fe-Mn during the pouring and then transferred to a DH vacuum degassing vessel where the molten steel was degassed by suction-up under a vacuum degree provided by a vacuum generator within a range of from 300 to 10 mmHg, while adjusting the vacuum degree in correspondence to the decarburization degree of the molten steel in such a pattern as: in the first 4 minute period in a range of from 300 to 150 mmHg; in the second 4 to 10 minute period in a range of from 100 to 60 mmHg; and in the third 10 to 15 minute period at 10 mmHg; and adjusting the height of the DH vacuum degassing vessel. Alloying elements were added during the degassing treatment in amounts as shown in Table 3 and the molten steel thus obtained was continuously cast by a continuous casting machine of curved strand type under the conditions as shown in Table 3. The results were that there was almost no nozzle clogging of the ladle and the tundish during the casting, and an Al-Si-killed steel having less internal defects and excellent surfacial quality was obtained, and as shown in the item of the slab analysis in Table 3, the level of H content in the steel was well within the allowable range.

COMPARISON 4

355 tons of molten pig iron consisting of 4.45% C, 0.50% Si, 0.55% Mn, 0.100% P, 0.020% S with the balance being iron was charged to a converter and the blowing was performed for 15 minutes to obtain the blow-off steel composition and temperature and the blow-off slag composition as shown in Table 3. The molten steel thus obtained was poured to a ladle with addition of a small addition (2.9 kg/t) of Fe-Mn during the pouring, and then transferred to a RH vacuum degassing vessel under a vacuum degree provided by a vacuum generator within a range of from 300 to 10 mmHg, while adjusting the vacuum degree in correspondence to the decarburization degree of the molten steel in such a pattern as: in the first 4 minute period in a range of from 300 to 150 mmHg; in the second 4 to 12 minute period in a range of from 100 to 60 mmHg; and in the third 12 to 18 minute period at 10 mmHg. Alloying elements were added at the end stage of the degassing treatment as shown in Table 3, and the molten steel thus obtained was continuously cast by a continuous casting machine of curved strand type under the conditions as shown in Table 3. The results were that there was much nozzle clogging of the ladle and the tundish and as much as 3.2% of the product was rejected because of the internal defects, and the product had a very inferior surfacial quality and required slab surface conditioning amounting to 19%.

COMPARISON 5

355 tons of molten pig iron consisting of 4.40% C, 0.50% Si, 0.55% Mn, 0.105% P, 0.020% S, with the balance being iron were charged to a converter and the blowing was performed for 16 minutes to obtain the blow-off steel composition and temperature and the blow-off slag composition as shown in Table 3. The molten steel thus obtained was poured to a ladle with addition of ferroalloy during the pouring, and then transferred to a RH vacuum degassing vessel where the molten steel was treated under a vacuum degree provided by a vacuum generator within a range of from 300 to 10 mmHg, while adjusting the vacuum degree in correspondence to the decarburization degree of the molten steel in such a pattern as: in the first 4 minute period in a range of from 300 to 150 mmHg; in the second 4 to 12 minute period in a range of from 100 to 60 mmHg; and in the third 12 to 18 minute period at 10 mmHg. Alloying elements were added at the end stage with less than 1.5 circulation being left as shown in Table 3, and the molten steel thus obtained was continuously cast by a continuous casting machine of curved stand type. The results were that there was much nozzle clogging of the ladle and the tundish, and as much as 3.2% of the product was rejected because of the internal defects, and the product had a very inferior surface quality and required slab surface conditioning amount to 19%.

COMPARISON 6

355 tons of molten pig iron consisting of 4.45% C, 0.50% Si, 0.55% Mn, 0.100% P, 0.020% S, with the balance being iron were charged to a converter and the blowing was performed for 16 minutes to obtain the blow-off steel composition and temperature and the blow-off slag composition as shown in Table 3. The molten steel thus obtained was poured to a ladle at 1650° C. with addition of ferro-alloy during the pouring, and then transferred to a RH vacuum degassing vessel where the molten steel was treated for 30 minutes under a high vacuum degree not larger than 1 mmHg maintained through the treatment, and very small amounts of Fe-Si and Fe-Mn and carburizing agent were added at the 25 minute point as shown in Table 3 to finely adjust the composition. The molten steel thus obtained was continuously cast by a continuous casting machine of curved strand type under the conditions as shown in Table 3. The resulting Al-Si-killed steel showed good quality for production of thick steel plates of 40 kg/mm$^2$ tensile strength, but showed a high level of N content as 43 ppm.

COMPARISON 7

355 tons of molten pig iron consisting of 4.45% C, 0.50% Si, 0.55% Mn, 0.100% P, 0.020% S, with the balance being iron were charged to a converter and the blowing was performed for 16 minutes to obtain the blow-off steel composition and temperature and the blow-off slag composition as shown in Table 3. The molten steel thus obtained was poured to a ladle at 1660° C. with addition of all required ferro-alloys, and then transferred to a RH vacuum degassing vessel, where the molten steel was treated for 30 minutes under a high vacuum degree not larger than 1 mmHg maintained during the treatment without addition of ferro-alloy during the degassing treatment. The molten steel thus obtained was continuously cast under the conditions as shown in Table 3 by a continuous casting machine of curved strand type. The resulting Al-Si-killed steel showed good quality for production of thick steel plates of 40 kg/mm$^2$ tensile strength, but showed a high level of N content as 48 ppm.

Table 1

| Steps | | Example 1 n = 20 charges | Example 2 n = 30 charges | Example 3 n = 25 charges | Comparison 1 n = 50 charges |
|---|---|---|---|---|---|
| Converter Operation | Blow-off [C] | 0.10 % | 0.05 % | 0.08 % | 0.04 % |
| | [Mn] | 0.25 % | 0.16 % | 0.23 % | 0.11 % |
| | Blow-off Temp. | 1636° C. | 1630° C. | 1633° C. | 1637° C. |
| | Blow-off slag (T . Fe) | 17 % | 21 % | 19 % | 24 % |
| | Ferro-alloy | | | | |

Table 1-continued

| Steps | | Example 1 n = 20 charges | Example 2 n = 30 charges | Example 3 n = 25 charges | Comparison 1 n = 50 charges |
|---|---|---|---|---|---|
| | Carburizing agent | 0 | 0 | 0 | 0 |
| | Fe—Mn | 0 | 1.5 kg/t-molten steel | 0 | 2.8kg/t-molten steel |
| | Al | 0 | 0 | 0 | 2.5kg/t-molten steel |
| Vacuum Degassing | Type | RH | RH | DH | — |
| | Vacuum degree | According to the pattern shown in Fig. 2(b) | | — | — |
| | | 250-25mmHg | 150-10mmHg | 200-10mmHg | — |
| | Treating time | 16 min. (4.0 circulations) | 12 min. (3.0 circulations) | 12 min. (3.5 circulations) | — |
| | Time point of alloy addition | 14 min. | 10 min. | 10 min. | — |
| | Ferro-alloy | | | | |
| | Carburizing agent | 0 | 0 | 0 | — |
| | Fe—Mn | 1.0kg/t-molten steel | 2.1kg/t molten steel | 1.3kg/t molten steel | — |
| | Al | 0.83 kg/t-molten steel | 0.95kg/t-molten steel | 0.86kg/t-molten steel | — |
| Continuous Casting | Tundish Temp. | 1543° C. (fluctuation $\sigma$ = 5° C.) | 1543° C. (fluctuation $\sigma$ = 5° C.) | 1545° C. (fluctuation $\sigma$ = 5° C.) | 1557° C. (fluctuation $\sigma$ = 9° C.) |
| | Casting speed | 1.6m/min. | 1.4m/min. | 1.0m/min. | 1.2m/min. |
| | Nozzle clogging | 0.5 % | 0.5 % | 0.4 % | 1.5 % |
| Slab Analysis | [C] | 0.05 % | 0.03 % | 0.05 % | 0.05 % |
| | [Si] | trace | trace | trace | trace |
| | [Mn] | 0.30 % | 0.30 % | 0.30 % | 0.30 % |
| | [P] | 0.015 % | 0.012 % | 0.013 % | 0.013 % |
| | [S] | 0.010 % | 0.010 % | 0.012 % | 0.010 % |
| | [sol . Al] | 0.050 % (fluctuation $\sigma$ = 0.003 %) | 0.050 % (fluctuation $\sigma$ = 0.003 %) | 0.050 % (fluctuation $\sigma$ = 0.003 %) | 0.048 % (fluctuation $\sigma$ = 0.013 %) |
| Quality | Percentage of satisfactory product free from defects | 100 % | 100 % | 100 % | 70 % (see Fig. 7) |
| | Surface conditioning | 3 % | 3 % | 2 % | 30 % (See Fig. 8) |

Table 2

| (1) Steps | | Example 4 | Example 5 | Example 6 | Example 7 | Example 8 | Comparison 2 | Comparison 3 |
|---|---|---|---|---|---|---|---|---|
| Converter Operation | Blow-off [C] | 0.07 % | 0.08 % | 0.13 % | 0.15 % | 0.14 % | 0.04 % | 0.10 % |
| | [Mn] | 0.16 % | 0.18 % | 0.22 % | 0.24 % | 0.24 % | 0.11 % | 0.19 % |
| | Blow-off Temp. | 1638° C. | 1635° C. | 1623° C. | 1628° C. | 1630° C. | 1630° C. | 1620° C. |
| | Blow-off Slab (T . Fe) | 19 % | 17 % | 15 % | 13 % | 14 % | 24 % | 17 % |
| | Ferro-alloy | | | | | | | |
| | Carburizing agent | 0 | 0 | 0 | 0 | 0 | 0 | 0 |
| | Fe—Mn | 3.1kg/t | 2.6kg/t | 1.5kg/t | 0 | 0 | 3.36kg/t | 6.29kg/t |
| | Fe—Si | 0 | 0 | 0 | 0 | 0 | 0.96kg/t | 2.04kg/t |
| | Al | 0 | 0 | 0 | 0 | 0 | 1.03kg/t | 0.10kg/t |
| Vacuum Degassing | Type | RH | RH | RH | RH | DH | — | — |
| | Vacuum degree | 250-20 mmHg | 200-30 mmHg | 210-15 mmHg | 190-20 mmHg | 200-20 mmHg | — | — |
| | Treating time | 16 min. | 12 min. | 13 min. | 14 min. | 13 min. | — | — |
| | Time point of alloy addition | 14 min. | 10 min. | 7 min. | 8 min. | 7 min. | — | — |
| | Ferro-alloy | | | | | | | |
| | Carburizing agent | 0.11kg/t | 0 | 0 | 0 | 0 | — | — |
| | Fe—Mn | 0.2 kg/t | 0.1kg/t | 3.4kg/t | 3.9kg/t | 4.0kg/t | — | — |
| | Fe—Si | 0.88kg/t | 0.94kg/t | 2.0kg/t | 1.9kg/t | 2.0kg/t | — | — |
| | Al | 0.30 (Si yield for stabilization) | 0 | 0.10 (Si yield for stabilization) | 0 | 0 | — | — |
| (2) Continuous casting | Tundish Temp. | 1545° C. (fluctuation $\sigma$=5° C.) | 1540° C. (fluctuation $\sigma$=5° C.) | 1537° C. (fluctuation $\sigma$=3° C.) | 1535° C. (fluctuation $\sigma$=4° C.) | 1535° C. (fluctuation $\sigma$=5° C.) | 1557° C. (fluctuation $\sigma$=9° C.) | 1545° C. (fluctuation $\sigma$=9° C.) |
| | Casting speed | 1.6m/min. | 1.8m/min. | 1.5m/min. | 1.5m/min. | 1.0m/min. | 1.2m/min. | 1.2m/min. |

Table 2-continued

| | | | | | | | | |
|---|---|---|---|---|---|---|---|---|
| | Nozzle clogging | 0.1 % | 0.2 % | 0.2 % | 0.1 % | 0.1 % | 1.5 % | 2.1 % |
| Slab Analysis | [C] | 0.05 % | 0.06 % | 0.14 % | 0.14 % | 0.13 % | 0.05 % | 0.14 % |
| | [Si] | 0.055 % | 0.050 % | 0.13 % | 0.12 % | 0.13 % | 0.055 % | 0.13 % |
| | [Mn] | 0.30 % | 0.29 % | 0.54 % | 0.50 % | 0.50 % | 0.30 % | 0.54 % |
| | [P] | 0.010 % | 0.010 % | 0.020 % | 0.018 % | 0.019 % | 0.010 % | 0.020 % |
| | [S] | 0.015 % | 0.015 % | 0.019 % | 0.020 % | 0.018 % | 0.015 % | 0.019 % |
| | [T . Al] | 0.002 % | — | 0.003 % | — | — | 0.003 % | 0.001 % |
| Quality | Percentage of slab requiring surface conditioning | 2 % | 2 % | 1 % | 3 % | 2 % | 15 % | 13 % |

Table 3

| (1) Steps | | Example 9 | Example 10 | Example 11 | Example 12 | Example 13 | Example 14 | Example 15 |
|---|---|---|---|---|---|---|---|---|
| | Al—Si killed steel | 40kg/mm$^2$ grade | 40kg/mm$^2$ grade | 50kg/mm$^2$ grade | 40kg/mm$^2$ grade | 40kg/mm$^2$ grade | API.X-52 grade | 40kg/mm$^2$ grade |
| | Tensile Strength | | | | | | | |
| | Blow-off [C] | 0.12 % | 0.11 % | 0.09 % | 0.10 % | 0.12 % | 0.10 % | 0.12 % |
| | [Mn] | 0.26 % | 0.20 % | 0.18 % | 0.20 % | 0.21 % | 0.25 % | 0.20 % |
| | Blow-off Temp. | 1625° C. | 1630° C. | 1640° C. | 1640 ° C. | 1635° C. | 1640° C. | 1632° C. |
| | Blow-off slag(T . Fe) | 15 % | 17 % | 18 % | 17 % | 18 % | 19 % | 16 % |
| Converter Operation | [H] | 0.9 PPM | 1.0 PPM | 1.1 PPM | 1.1 PPM | 1.0 PPM | 1.0 PPM | 1.0 PPM |
| | Pouring Fe—Si Addition | — | — | — | — | — | — | — |
| | Fe—Mn Addition | — | 2.9kg/T-S | 2.9kg/T-S | 2.9kg/T-S | 2.9kg/T-S | — | 2.9kg/T-S |
| | Al Addition | — | — | — | — | — | — | — |
| | [H] | 1.5 PPM | 1.6 PPM | 1.7 PPM | 1.4 PPM | 1.6 PPM | 1.2 PPM | 1.6 PPM |
| | [N] | 18 PPM | 16 PPM | 17 PPM | 17 PPM | 16 PPM | 19 PPM | 17 PPM |

| (2) | | | | | | | | | |
|---|---|---|---|---|---|---|---|---|---|
| | | Type | RH | RH | RH | RH | RH | RH | DH |
| | | Treating Time | 18 min. | 18 min. | 18 min. | 18 min. | 18 min. | 18 min. | 15 min. |
| | | Circulating Number during Treatment | 4.5 | 4.5 | 4.5 | 4.5 | 4.5 | 4.5 | 4.3 |
| | Main Additives | Time point of Addition : Amount | | | | | | | |
| | | Fe—Si | 7 min. 3.13kg/T-S | 3 min. 3.29kg/T-S | 3 min. 3.20kg/T-S | 3 min. 3.29kg/T-S | 3 min. 3.00kg/T-S | 3 min. 3.29kg/T-S | 3 min. 3.29kg/T-S |
| | | Fe—Mn | 7 min. 5.04kg/T-S | 3 min. 6.14kg/T-S | 3 min. 15.85kg/T-S | 3 min. 6.14kg/T-S | 3 min. 4.30kg/T-S | 3 min. 8.59kg/T-S | 3 min. 6.04kg/T-S |
| | | Al | 11 min. 0.29kg/T-S | 11 min. 0.29kg/T-S | 11 min. 0.44kg/T-S | 11 min. 0.25kg/T-S | 11 min. 0.28kg/T-S | 11 min. 0.26kg/T-S | 9.8 min. 0.29kg/T-S |
| Vacuum De-gassing Vessel | | ΔN of Fe—Si and Fe-Mn | 2.75 | 3.75 | 3.75 | 3.75 | 3.75 | 3.75 | 3.46 |
| | Adjustments | Time point of Addition : Amount | | | | | | | |
| | | Fe—Si | — | — | — | — | 16 min. 0.42kg/T-S | — | — |
| | | Fe—Mn | — | — | — | — | 16 min. 1.90kg/T-S | — | — |
| | | Al | — | — | — | — | — | — | — |
| | | Others | — | — | — | Fe-Nb 11 min. 0.48kg/T-S | — | REM 12 min. 0.35kg/T-S Fe-Nb 12 min. 0.48kg/T-S | — |

| (3) | | | | | | | | |
|---|---|---|---|---|---|---|---|---|
| Continuous Casting | Occurrence of Nozzle clogging of ladle | 5 % (n = 55 charge) | 0 % (n = 60 charge) | 0 % (n = 13 charge) | 0 % (n = 15 charge) | 0 % (n = 20 charge) | 0 % (n = 5 charge) | 0 % (n = 20 charge) |
| | Tundish Temp. of molten steel | 1525 – 1545° C. | 1520 – 1540° C. | 1520 – 1540° C. | 1520 – 1540° C. | 1518 – 1529° C. | 1520 – 1525° C. | 1520 – 1540° C. |
| | Casting speed | 1.30m/min. | 1.80m/min. | 1.20m/min. | 1.6m/min. | 1.6m/min. | 1.7m/min. | 1.0m/min. |
| Slab Analysis | [C] | 0.10 % | 0.15 % | 0.15 % | 0.13 % | 0.14 % | 0.13 % | 0.16 % |
| | [Si] | 0.20 % | 0.20 % | 0.20 % | 0.20 % | 0.22 % | 0.20 % | 0.20 % |
| | [Mn] | 0.60 % | 0.80 % | 1.42 % | 0.81 % | 0.82 % | 0.83 % | 0.79 % |
| | [P] | 0.025 % | 0.025 % | 0.018 % | 0.018 % | 0.018 % | 0.017 % | 0.023 % |
| | [S] | 0.022 % | 0.022 % | 0.010 % | 0.013 % | 0.016 % | 0.005 % | 0.020 % |
| | [T . Al] | 0.018 % | 0.018 % | 0.027 % | 0.015 % | 0.017 % | 0.015 % | 0.018 % |
| | [H] | 1.1 PPM | 1.3 PPM | 1.2 PPM | 1.0 PPM | 1.4 PPM | 1.0 PPM | 1.4 PPM. |
| | [N] | 20 PPM | 17 PPM | 19 PPM | 17 PPM | 17 PPM | 19 PPM | 18 PPM |
| | Others | — | — | — | Nb:0.03 % | — | REM:0.012-5% Nb: 0.03 % | — |
| Quality | Percentage of surface conditioning of the plates | 13 % | 9 % | 11 % | 9 % | 7 % | 10 % | 7 % |
| | Reject percentage | | | | | | | |

Table 3-continued

| | | | | | | | | |
|---|---|---|---|---|---|---|---|---|
| | of slab due to internal defects | 1.2 % | 1.0 % | 1.2 % | 0.7 % | 0.6 % | 0.8 % | 0.9 % |

(T-S: ton of molten steel)
(Time point of Addition: Time from the start of the degassing treatment)
(ΔN: Circulation number after the addition)

(4)

| | | | Comparison 4 | Comparison 5 | Comparison 6 | Comparison 7 |
|---|---|---|---|---|---|---|
| | | Al—Si killed steel Tensile Strength | 40kg/mm²grade | 40kg/mm²grade | 40kg/mm²grade | 50kg/mm²grade |
| Converter Operation | | Blow-off [C] | 0.11 % | 0.10 % | 0.08 % | 0.09 % |
| | | [Mn] | 0.21 % | 0.20 % | 0.19 % | 0.18 % |
| | | Blow-off Temp. | 1635° C. | 1640° C. | 1650° C. | 1660° C. |
| | | Blow-off slag(T.Fe) | 18 % | 17 % | 18 % | 18 % |
| | | [H] | 1.0 PPM | 1.1 PPM | 0.8 PPM | 0.9 PPM |
| | | Pouring Fe—Si Addition | — | — | 2.77kg/t | 2.77kg/t |
| | | Fe—Mn Addition | 2.9kg/t | 2.9kg/t | 9.12kg/t | 18.24kg/t |
| | | Al Addition | — | — | 0.98kg/t | 1.03kg/t |
| Vacuum Degassing Vessel | | [H] | 1.2 PPM | 1.4 PPM | 2.7 PPM | 3.5 PPM |
| | | [N] | 18 PPM | 17 PPM | 34 PPM | 41 PPM |
| | | Type | RH | RH | RH | RH |
| | | Treating Time | 18 min. | 18 min. | 30 min. | 30 min. |
| | | Circulation Number during Treatment | 4.5 | 4.5 | 7.5 | 7.5 |
| | Main Additives | Fe—Si(Time point of Addition) | 12.5 min. | 14 min. | — | — |
| | | (Amount) | 3.30kg/t | 3.29kg/t | — | — |
| | | Fe—Mn (Time point of Addition) | 12.5 min. | 14 min. | — | — |
| | | (Amount) | 6.67kg/t | 6.14kg/t | — | — |
| | | Al (Time point of Addition) | 14 min. | 16 min. | — | — |
| | | (Amount) | 0.25kg/t | 0.25kg/t | — | — |
| | | ΔN of Fe—Si and Fe—Mn | 1.375 | 1.0 | — | — |

(5)

| | | | | | | |
|---|---|---|---|---|---|---|
| Vacuum Degassing Vessel | Adjustments | Fe—Si(Time point of Addition) | — | — | 25 min. | — |
| | | (Amount) | — | — | 0.14kg/t | — |
| | | Fe-Mn(Time point of Addition) | — | — | 25 min. | — |
| | | (Amount) | — | — | 0.15kg/t | — |
| | | Al | — | — | — | — |
| | | Others(Time point of Addition) | — | — | 25 min.[C] | — |
| | | (Amount) | — | — | 0.23kg/t | — |
| | Occurrence of nozzle clogging of ladle | | 40 % (n = 10 charge) | 70 % (n = 15 charge) | 0 % (n = 15 charge) | 0 % (n = 13 charge) |
| Continuous Casting | Tundish Temp. of molten steel | | 1525 - 1540° C. | 1520 - 1540° C. | 1525- 1545° C. | 1520 - 1540° C. |
| | Casting speed | | 1.5m/min. | 1.6m/min. | 1.15m/min. | 1.15m/min. |
| Slab Analysis | [C] | | 0.13 % | 0.13 % | 0.14 % | 0.15 % |
| | [Si] | | 0.20 % | 0.20 % | 0.20 % | 0.20 % |
| | [Mn] | | 0.80 % | 0.81 % | 0.80 % | 1.40 % |
| | [P] | | 0.018% | 0.018% | 0.020% | 0.020% |
| | [S] | | 0.012% | 0.013% | 0.018% | 0.012% |
| | [T . Al] | | 0.016% | 0.015% | 0.018% | 0.025% |
| | [H] | | 0.9 PPM | 1.0 PPM | 1.2 PPM | 1.3 PPM |
| | [N] | | 20 PPM | 18 PPM | 43 PPM | 48 PPM |
| | Others | | — | — | — | — |
| Quality | Percentage of surface conditioning of the slabs | | 19 % | 23 % | 5 % | 8 % |
| | Reject percentage of plates due to internal defects | | 3.2% | 7.0% | 0.6% | 0.7% |

What is claimed is:

1. A method for producing killed molten steel for continuous casting comprising:
   (a) preparing molten steel with a blow-off carbon content of not less than 0.05% in a converter;
   (b) pouring the molten steel into a ladle; and
   (c) degassing the molten steel in a vacuum degassing vessel under a vacuum from 10 to 300 mmHg, the vacuum being increased proportionately to the rate of decarburization of the melt with the addition of manganese, silicon, or aluminum during the degassing.

2. A method according to claim 1, in which the molten steel is poured from the converter to a ladle and Fe-Mn is added to the molten steel during the pouring.

3. A method according to claim 1, in which Si and Mn are added during the degassing treatment the molten steel is circulated at least one and half time after the addition, and then Al is added.

4. A method according to claim 1 in which an element required for adjusting the molten steel composition is added during the vacuum degassing treatment.

5. A vacuum degassing apparatus comprising;
   a vacuum degassing vessel,
   a molten metal receptacle which forms a flow path for the molten metal with the vacuum degassing vessel,
   a detecting device for detecting the vacuum degree in the vacuum degassing vessel, a comparison control device which outputs a required distance from the upper surface of the molten metal in the molten metal receptacle to a bottom surface of the degassing vessel on the basis of a preset vacuum degree, and a lifting device which receives the output from the comparion control device and moves up and down at least one of the vacuum degassing vessels and the molten metal receptacle to maintain the required distance.

6. A vacuum degassing apparatus according to claim 5, which further comprises;

a detecting device for detecting a decarburization degree of the molten steel and a vacuum degree in the vacuum degassing vessel, a vacuum instruction device for outputting an instruction of a required vacuum degree in the vacuum degassing vessel on the basis of the decarburization degree of the molten metal detected by the detecting device, and an exhausting device which maintains the required vacuum degree in the vacuum degassing vessel in correspondence to the output from the vacuum instructing device.

* * * * *